US011279516B2

(12) United States Patent
Valdés Abramo et al.

(10) Patent No.: US 11,279,516 B2
(45) Date of Patent: Mar. 22, 2022

(54) PALLET WITH IMPACT RESISTANT COLUMNS

(71) Applicant: Plasticos Tecnicos Mexicanos, S.A. de C.V., Querétaro (MX)

(72) Inventors: Juan Pablo Valdés Abramo, Querétaro (MX); Andrés Álvarez Vargas, Querétaro (MX); Adrián Andrade Ontiveros, Querétaro (MX); Martha Valeria Ávila Hernández, Querétaro (MX); Felicitaz Elizabeth Ávila Ramírez, Querétaro (MX); Juan Pedro Baca Sánchez, Querétaro (MX); Nallely Balbino Tovar, Querétaro (MX); Ciro Feregrino Montes, Querétaro (MX); Alejandro Gómez Caudillo, Querétaro (MX); Luis Joaquín Martínez Layseca, Querétaro (MX); José Ricardo Peña Zapata, Querétaro (MX); Claudia Estefanía Pineda Hernández, Querétaro (MX); Juan Ruiz Estrella, Querétaro (MX); Daniel Servín Frías, Querétaro (MX); Karen Iraís Vargas Montiel, Querétaro (MX); José Alberto Vázquez Ramírez, Querétaro (MX)

(73) Assignee: PLÁSTICOS TÉCNICOS MEXICANOS, S.A. DE C.V., Querétaro (MX)

( * ) Notice: Subject to any disclaimer, the term of this patent is extended or adjusted under 35 U.S.C. 154(b) by 0 days.

(21) Appl. No.: 16/625,613

(22) PCT Filed: Dec. 6, 2017

(86) PCT No.: PCT/MX2017/000144

§ 371 (c)(1),
(2) Date: Dec. 20, 2019

(87) PCT Pub. No.: WO2019/112410

PCT Pub. Date: Jun. 13, 2019

(65) Prior Publication Data

US 2021/0284387 A1 Sep. 16, 2021

(51) Int. Cl.
*B65D 19/00* (2006.01)

(52) U.S. Cl.
CPC ..... *B65D 19/0026* (2013.01); *B65D 2519/00034* (2013.01); *B65D 2519/00069* (2013.01);
(Continued)

(58) Field of Classification Search
CPC ..... B65D 19/38
(Continued)

(56) References Cited

U.S. PATENT DOCUMENTS 3,178,778 A * 4/1965 Reahard ..... F25D 23/087 49/496.1
3,318,061 A * 5/1967 Stentz ..... E04F 19/028 52/288.1
(Continued)

FOREIGN PATENT DOCUMENTS

| | | |
|---|---|---|
| CN | 203698869 | 7/2014 |
| EP | 1 095 867 A1 | 5/2001 |
| WO | WO 2005/102853 | 11/2005 |

*Primary Examiner* — Jose V Chen
(74) *Attorney, Agent, or Firm* — Knobbe Martens Olson & Bear LLP

(57) ABSTRACT

The present invention relates to a pallet with impact resistant columns (3) comprising a structure for the distribution of impact energy (4) configured for the distribution of impact forces, at the same time as its internal structure deforms and is compacted upon receiving impacts, such that the pallet remains functional although its columns (3) are permanently deformed and/or partially fractured.

21 Claims, 25 Drawing Sheets

(52) U.S. Cl.
CPC ..... *B65D 2519/00139* (2013.01); *B65D 2519/00273* (2013.01); *B65D 2519/00288* (2013.01); *B65D 2519/00318* (2013.01); *B65D 2519/00333* (2013.01); *B65D 2519/00363* (2013.01); *B65D 2519/00442* (2013.01); *B65D 2519/00562* (2013.01); *B65D 2519/00567* (2013.01); *B65D 2519/00572* (2013.01); *B65D 2519/00796* (2013.01)

(58) Field of Classification Search
USPC ..... 108/51.11–57.34
See application file for complete search history.

(56) References Cited

U.S. PATENT DOCUMENTS 3,508,679 A * 4/1970 Semple ..... B65D 1/40 220/675
3,552,328 A 1/1971 Sullivan
3,565,278 A * 2/1971 Houston ..... B65D 1/243 220/516
3,648,883 A * 3/1972 Bridenstine ..... B65D 1/34 220/607
3,750,596 A * 8/1973 Box ..... B65D 19/0014 108/53.1
3,750,598 A 8/1973 Campbell
3,814,030 A * 6/1974 Morgan, III ..... B65D 19/0012 108/57.25
3,917,066 A * 11/1975 Cloyd ..... B65D 71/70 206/597
4,700,959 A * 10/1987 Lars ..... B62B 3/00 108/56.1
4,887,537 A * 12/1989 Kellogg ..... B65D 19/44 108/55.1
5,180,134 A * 1/1993 Mallak ..... B65G 7/02 108/55.1
6,138,582 A * 10/2000 Fujii ..... B65D 19/0012 108/57.25
6,216,608 B1 * 4/2001 Woods ..... B65D 19/0012 108/56.1
6,357,366 B1 * 3/2002 Frankenberg ..... B65D 19/0026 108/57.25
6,708,628 B2 * 3/2004 Halavais ..... B65D 19/0051 108/51.11
6,807,911 B2 * 10/2004 Carson ..... B65D 19/0018 108/57.28
6,857,377 B2 * 2/2005 Herring ..... B65D 19/0018 108/51.11
6,874,428 B2 4/2005 Apps
7,637,219 B2 * 12/2009 Hartel ..... B65D 19/0012 108/51.11
10,780,906 B2 * 9/2020 Takyar ..... B62B 3/16
2006/0201399 A1 9/2006 Swistak
2006/0236903 A1 10/2006 Moore, Jr.
2008/0178775 A1 * 7/2008 Strobl ..... B65D 19/0012 108/57.26
2010/0218705 A1 * 9/2010 Mani ..... B65D 19/0073 108/57.17
2012/0325125 A1 12/2012 Apps
2014/0283714 A1 * 9/2014 Wahl ..... B65D 19/0014 108/51.11
2016/0023803 A1 * 1/2016 Green ..... B65D 19/0095 108/57.12
2016/0288951 A1 10/2016 Rader
2016/0368659 A1 12/2016 Bastian
2019/0144163 A1 * 5/2019 Lim ..... B65D 19/004 108/53.5
2021/0055152 A1 * 2/2021 Ekkel ..... G01G 19/52

* cited by examiner

PALLET WITH IMPACT RESISTANT COLUMNS

TECHNICAL FIELD

The present invention is related to the field of articles for the transport of goods and, in particular, relates to a pallet having impact-resistant columns, wherein its columns are configured for the distribution of impact forces produced mainly by the forks of the forklifts, at the same time that their internal structure is deformed and compacted upon receiving impacts, so that the pallet is still functional although its columns have been permanently deformed and/or partially fractured.

BACKGROUND OF THE INVENTION

Wood pallets have long been used to transport goods, particularly in the transport and packaging industries. Currently, the demand for plastic pallets has increased, since particular qualities of the material are exploited, especially that they are more resistant, hygienic, and generate less waste and environmental impact.

Commercially, plastic pallets used for the storage and transport of various merchandise are lighter and more durable than wooden pallets. They have columns to provide greater support to the load placed, and entries between the columns to receive the forks or tines of a forklift, which can often impact the columns of the pallet generating damage and wear.

It is desirable to reduce the impact caused by the forks during pallet manoeuvres, so that the damage caused to them is minimal and that the life of the pallet is prolonged.

In the state of the art, two-piece pallets are known, as described in U.S. Pat. No. 8,874,428 B2, which have an upper and lower member, both with a plurality of ribs that confer strength and durability, but so far do not have a system that dampens the impact caused by the forks.

On the other hand, there are pallets such as the one described in the US Patent Application No. US 2012/0325125 A1, which has two main pieces and several support members, where the upper deck has a plurality of ribs that form the upper portion of the columns, which in turn are hollow and do not have a mechanism that dampens the impact by forklift forks.

Additionally, there are pallets such as those described in US Patent Application No. US 2008/0236903, which contemplate the injection of plastic foam with the aim of increasing the strength of the columns and making them more resistant to impact. However, there is no pallet that has a special structure that acts in conjunction with a plastic foam to absorb the impact generated.

A problem that also occurs when using conventional plastic pallets, is when any of its columns is deformed and/or partially fractured by the impact of the fork of a forklift, which dramatically decreases its load capacity, to the point of making the pallet unusable most of the time.

Therefore, there is a need for a plastic pallet that meets the aforementioned characteristics and that solves the technical problem of dampening the frequent impacts of forklift forks on the columns of the plastic pallet. Likewise, it is desirable to have a pallet that remains functional, despite having deformation and/or fracture in its columns.

SUMMARY OF THE INVENTION

It is therefore an objective of the present invention to provide a pallet having impact-resistant columns, having a configuration for distributing the energy produced by an impact.

Another objective of the present invention is to provide a pallet having impact-resistant columns, comprising a top deck, bottom deck, and optionally portions of plastic foam.

Another objective of the present invention is to provide a pallet having impact-resistant columns, which can be used more than once to transport goods.

Another objective of the present invention is to provide a pallet having impact-resistant columns, designed to reduce the effects of torque and flexion during use.

Another objective of the present invention is to provide a pallet having impact-resistant columns, designed to reduce the weight thereof.

A further objective of the present invention is to provide a pallet having impact-resistant columns, which remains functional, despite showing deformation and/or fracture in its columns,

DETAILED DESCRIPTION OF THE INVENTION

Figure 1:
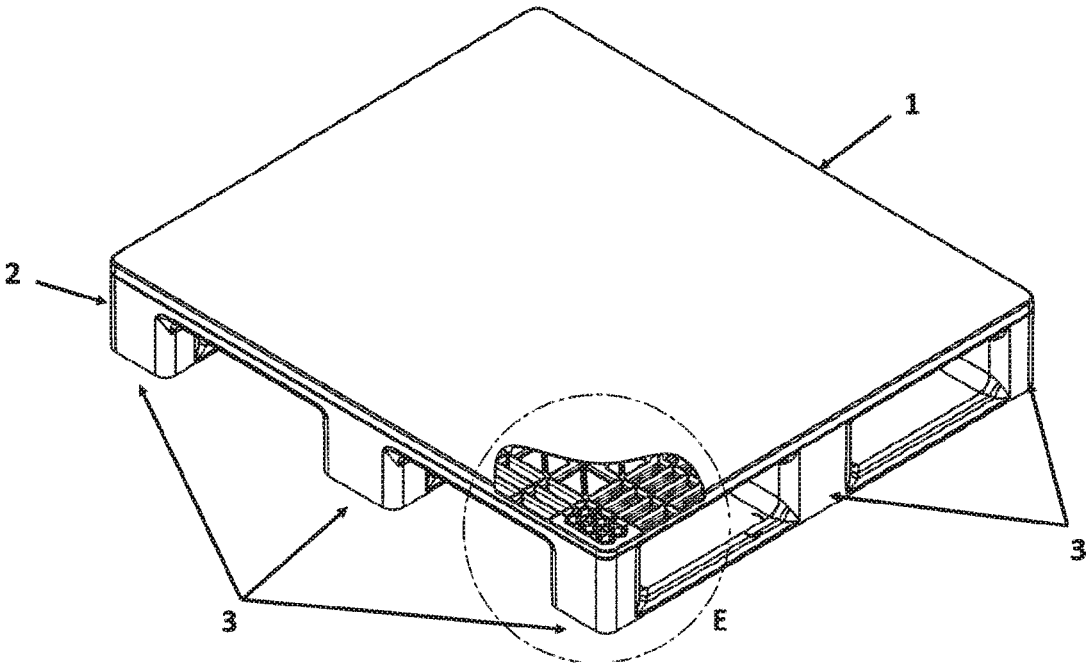
FIG. 1 is a top perspective view of the pallet having impact-resistant columns in one embodiment of the present invention, showing the top deck (1) with a partial horizontal cut, the bottom deck (2) and the columns (3).
Figure 2:
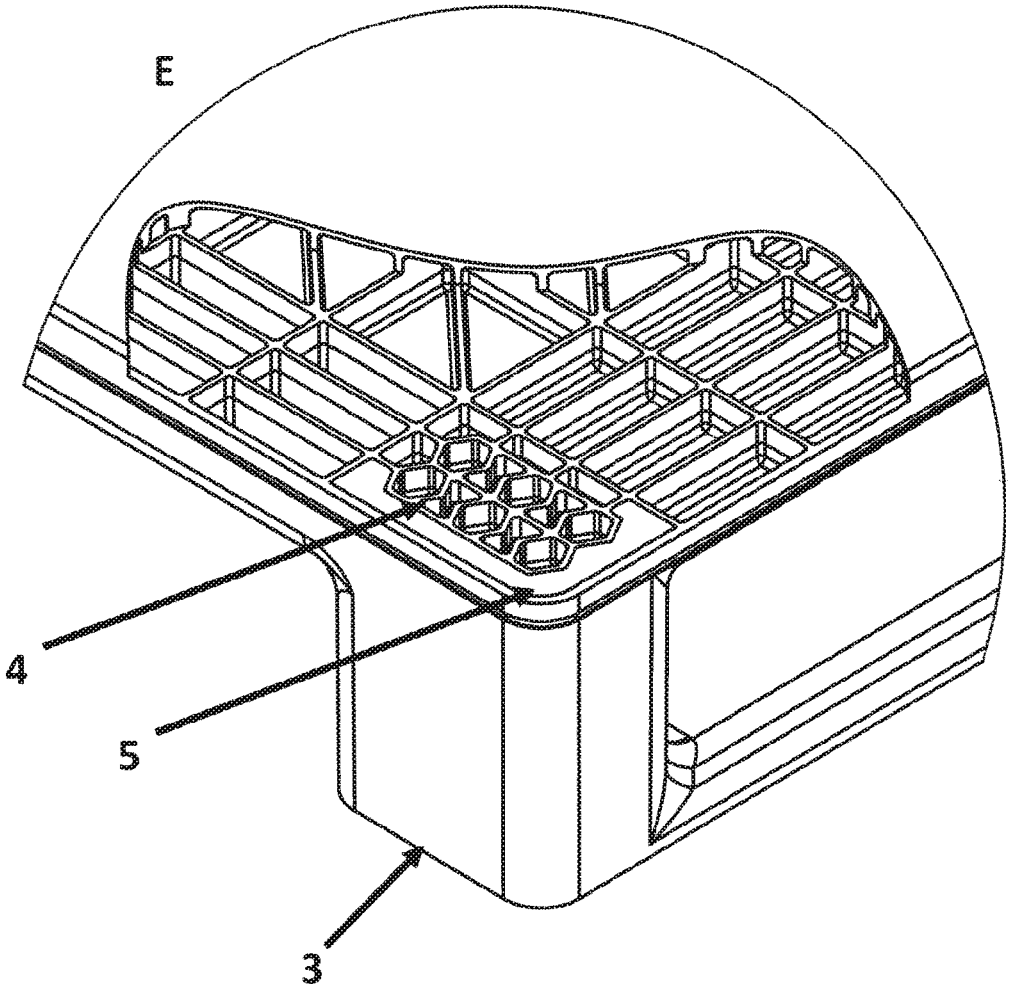
FIG. 2 is a detailed view "E" of the partial horizontal section of the top deck (1) of the pallet having impact-resistant columns in one embodiment of the present invention, showing the structure for impact energy distribution (4) and the plastic foam portion (5) inside the column (3).
Figure 3:
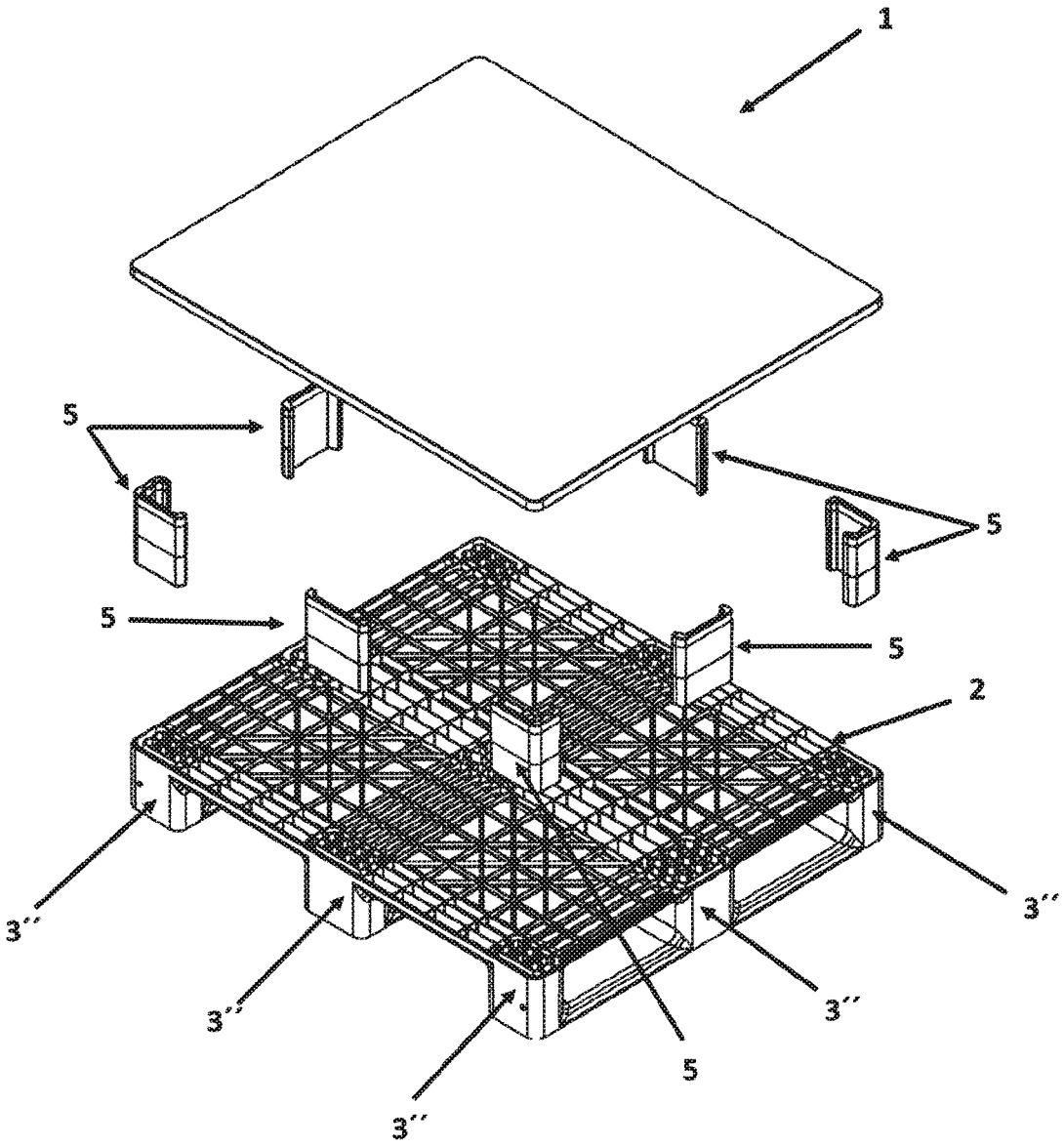
FIG. 3 is a top perspective exploded view of the pallet having impact-resistant columns in an embodiment of the present invention, showing the top deck (1), the bottom deck (2), the lower column segments (3") and plastic foams (5).
Figure 4:
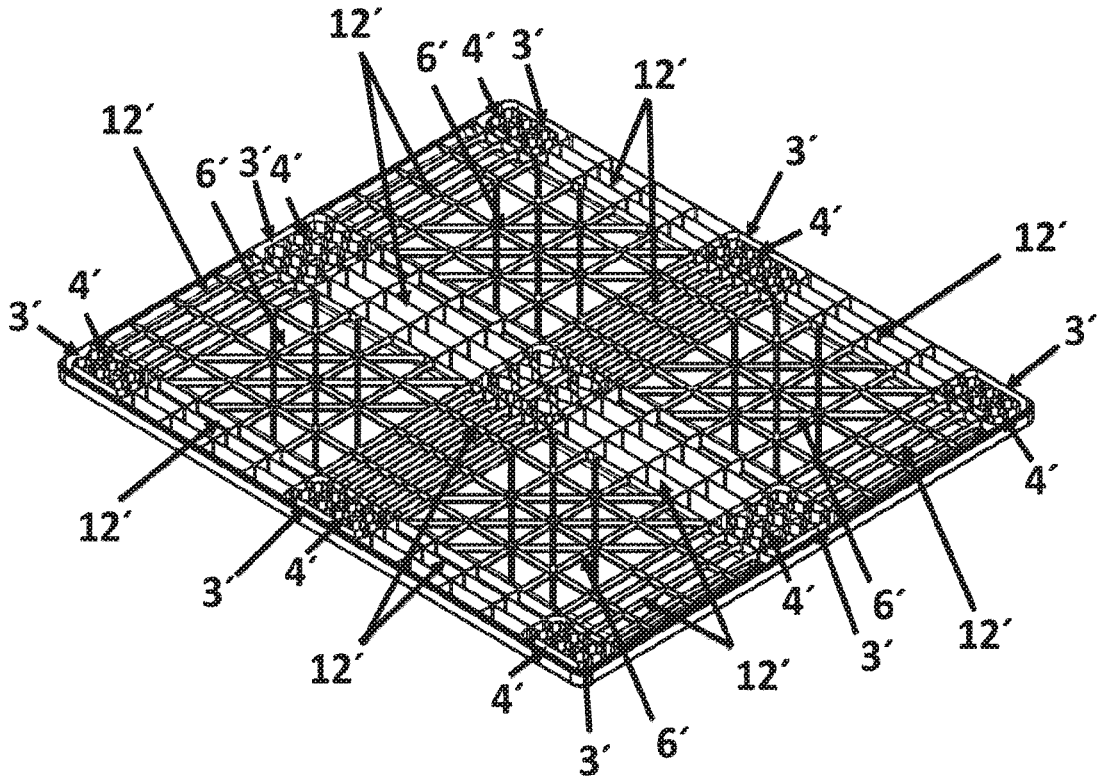
FIG. 4 is a bottom perspective view of the top deck (1) of the pallet having impact-resistant columns in an embodiment of the present invention, showing the upper column segments (3'), the upper segments of structure for impact energy distribution (4'), cross ribs (6') and simple ribs (12').

The present invention relates to a pallet having impact-resistant columns comprising a top deck (1), which is in turn formed by an upper face, a lower face, a left side face, a right side face, a front face and a rear face, wherein the lower face includes at least one upper segment of column (3') with an upper segment of structure for impact energy distribution (4') inside, a plurality of crossed ribs (6') and a plurality of simple ribs (12');

a bottom deck (2), which is in turn formed by an upper face, a lower face, a left side face, a right side face, a front face and a rear face, wherein the upper face includes at least one segment lower column (3") with a lower structure segment for impact energy distribution (4") inside, a plurality of crossed ribs (6), a plurality of simple ribs (12), and optionally, at least one fork runner (7) and a runner (8);

where the union of the lower face of the top deck (1) with the upper face of the bottom deck (2), form at least one column (3) with a structure for distribution of impact energy (4) inside it;

wherein the structure for distribution of impact energy (4), is in turn formed by at least two rows of springs in the form of a polygonal prism and/or cylinders and/or portions thereof, the cross section of said polygonal prisms is different from a rectangle or a square.

The at least one column (3), is formed by an upper segment of column (3') that belongs to the top deck (1) and a lower segment of column (3") that belongs to the bottom deck (2), however, it is also possible that the column (3) is formed in one piece in one embodiment of the invention.

In the same way, the structure for impact energy distribution (4), is formed by an upper segment of structure for impact energy distribution (4') belonging to the top deck (1) and a lower segment of structure for impact energy distribution (4") that belongs to the bottom deck (2), however, it is also possible that the structure for impact energy distribution (4) is formed in one piece within a column in another embodiment of the invention.

It should be noted that the pallet having impact-resistant columns of the present invention can be configured in different ways, since there are different structure designs for impact energy distribution (4), which in turn can be combined with other auxiliary elements of damping, such as, for example, portions of plastic foam (5) and/or pneumatic chambers (13), and/or reinforcements and/or inserts, thus improving the mechanical properties of the column (s) (3). There is also the possibility of optionally including reinforcements or inserts in other areas of the pallet to increase its resistance.

Figure 16:
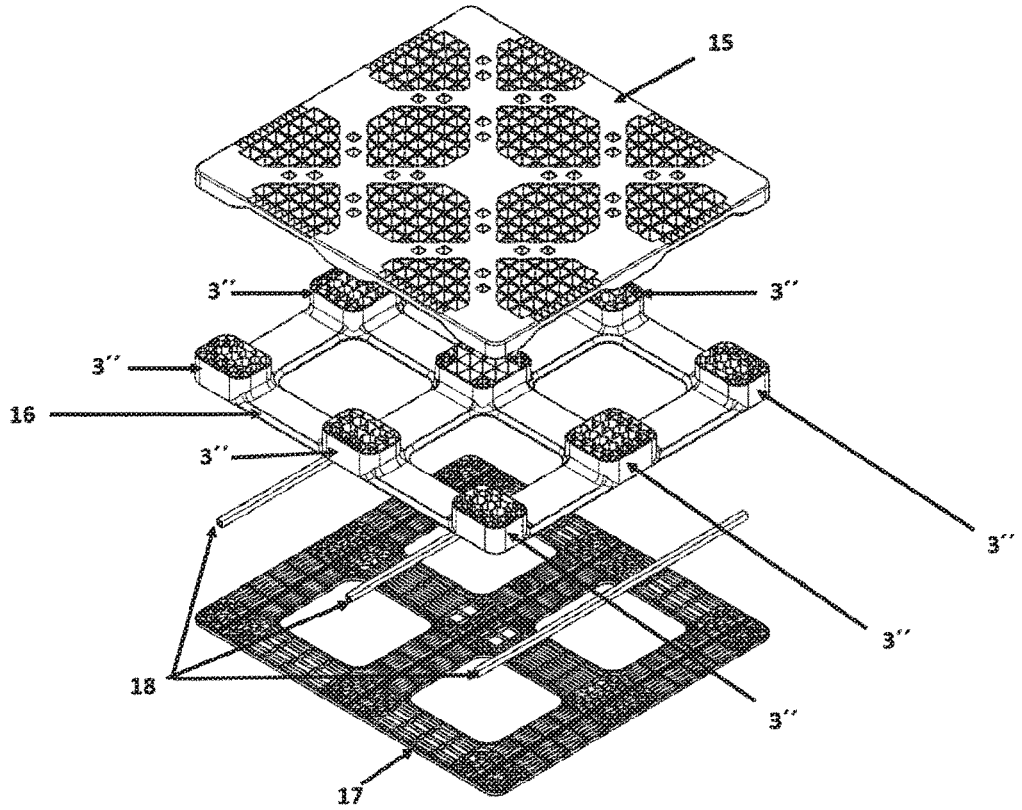
FIG. 16 is a top perspective view of the exploded view of the pallet having impact-resistant columns in an embodiment of the present invention, where the top deck (15), the lower column segments (3"), the bottom deck (16), the bottom cover (17) and reinforcements (18).
Figure 17:
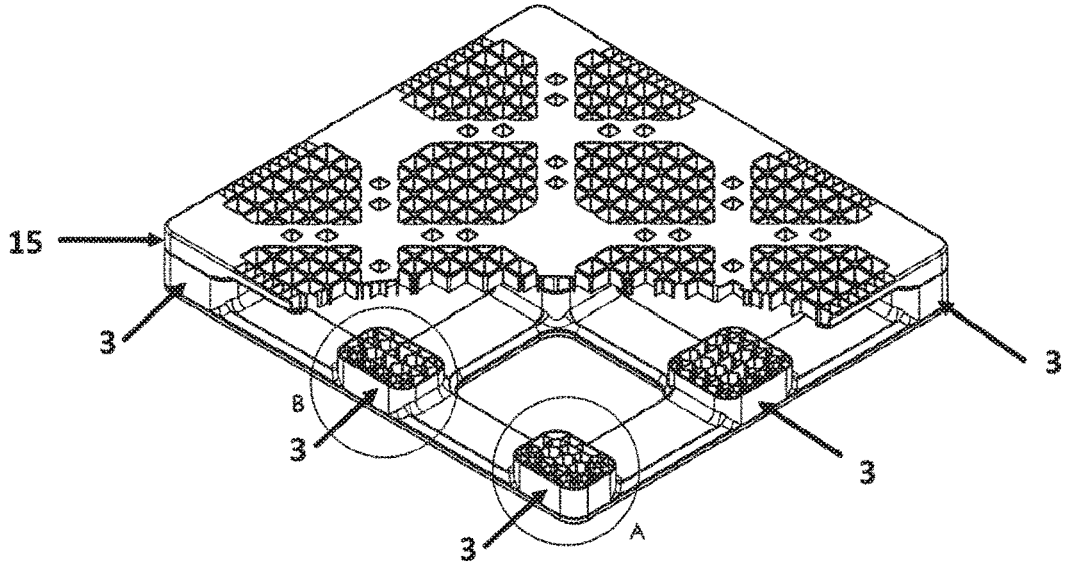
FIG. 17 is a top perspective view of the pallet having impact-resistant columns in an embodiment of the present invention, showing the top deck (15) with a cross-section and the columns (3).

Also, the pallet having impact-resistant columns of the present invention can be made up of different types and quantity of pieces. For example, the pallet having impact-resistant columns can be made up of two types of pieces: a top deck (1) and a bottom deck (2), as shown in FIG. 1, However, it can also be made up of four types of parts: a top cover (15), a central structure (16), a bottom cover (17) and reinforcements (18), as shown in FIG. 16. Therefore, this description will rely on different embodiments for its explanation. It should be noted that both the top deck (1) and the bottom deck (2) can be made up of a plurality of pieces each. For example, the central structure (16) and the bottom cover (17) of an embodiment of the present invention could be manufactured as a single new part, however said new part would have the same characteristics as the bottom deck (2) of the different embodiments of the present invention.

Moreover, due to the design characteristics of the pallet having impact-resistant columns, it is possible that the top deck (1) and the bottom deck (2) can be integrated in one piece.

The columns (3), are located in the periphery of the pallet of the present invention, and/or in the internal part thereof. Its purpose is to function as supports that create spaces between them, where these spaces allow the forklift of a forklift to be inserted. These spaces are called fork runners (7). However, the main feature of the columns (3) is its configuration to resist and absorb impacts caused by the forks during their insertion into said fork runners (7), since the structure for the distribution of energy of impact (4) is mechanically deformed to reduce the destructive effects of said impact, while maintaining the carrying capacity and functionality of the column (s) (3).

The structure for the distribution of impact energy (4) has a geometric configuration specially designed to allow the distribution of the energy produced by the impacts of the forklift forks (9), since it is formed by springs that provide deformation to the columns (3), thus decreasing the stiffness of each column (3), while increasing its deformability, and consequently, the risk of breaking the columns (3) is reduced.

Said springs of the structure for the distribution of impact energy (4), are in the form of polygonal prisms and/or cylinders with a cross-section other than a rectangle or square, i.e., their cross-section can be triangular, rhomboid, trapezoidal, pentagonal, hexagonal, heptagonal, circular, etc., as well as any other polygonal figure wherein its sides do not form right angles to each other.

The orientation of the polygonal prisms and/or cylinders coincides with that of the column (3) that contains them, since the longitudinal axis of said prisms and/or cylinders is parallel or coincides with the longitudinal axis of said column (3).

The springs that make up the structures for the distribution of impact energy (4) can be separated from each other, or they can share partial or totally, one or several of its lateral faces.

Figure 12:
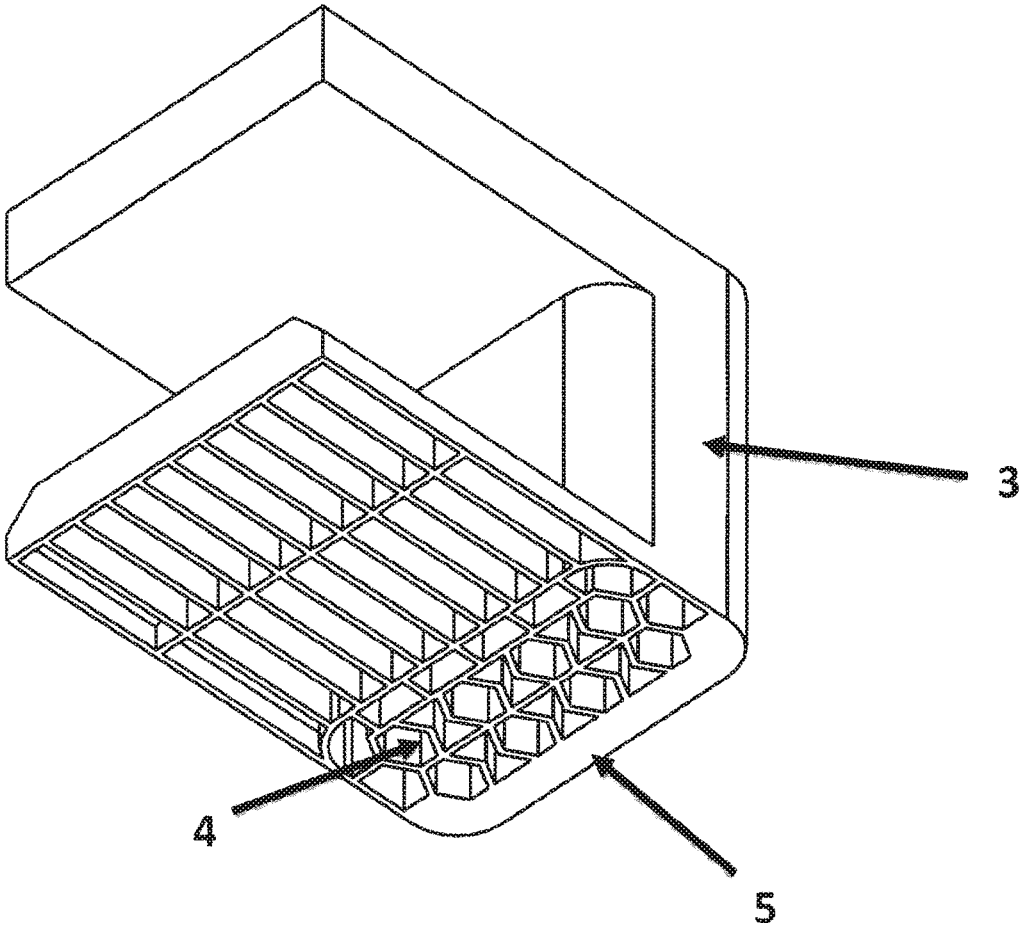
FIG. 12 is a bottom perspective view of the column (3) of the pallet having impact-resistant columns in an embodiment of the present invention, showing the structure for impact energy distribution (4) and the plastic foam portion (5).
Figure 13:
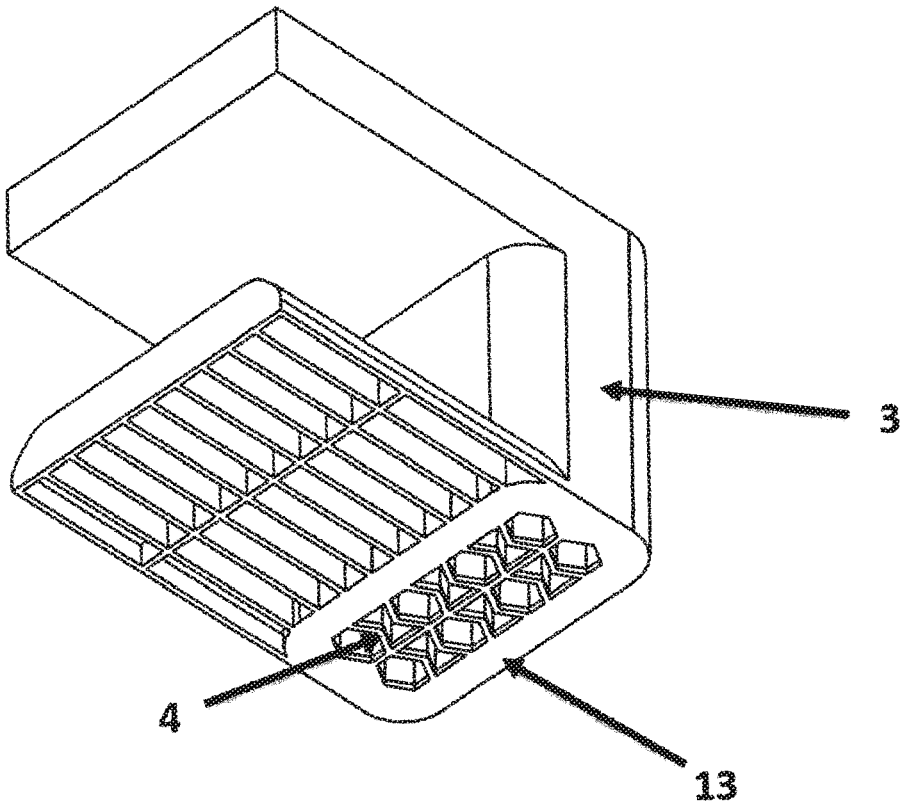
FIG. 13 is a bottom perspective view of the pallet column (3) with impact-resistant columns in an embodiment of the present invention, showing the structure for impact energy distribution (4) and the pneumatic chamber (13).
Figure 14:
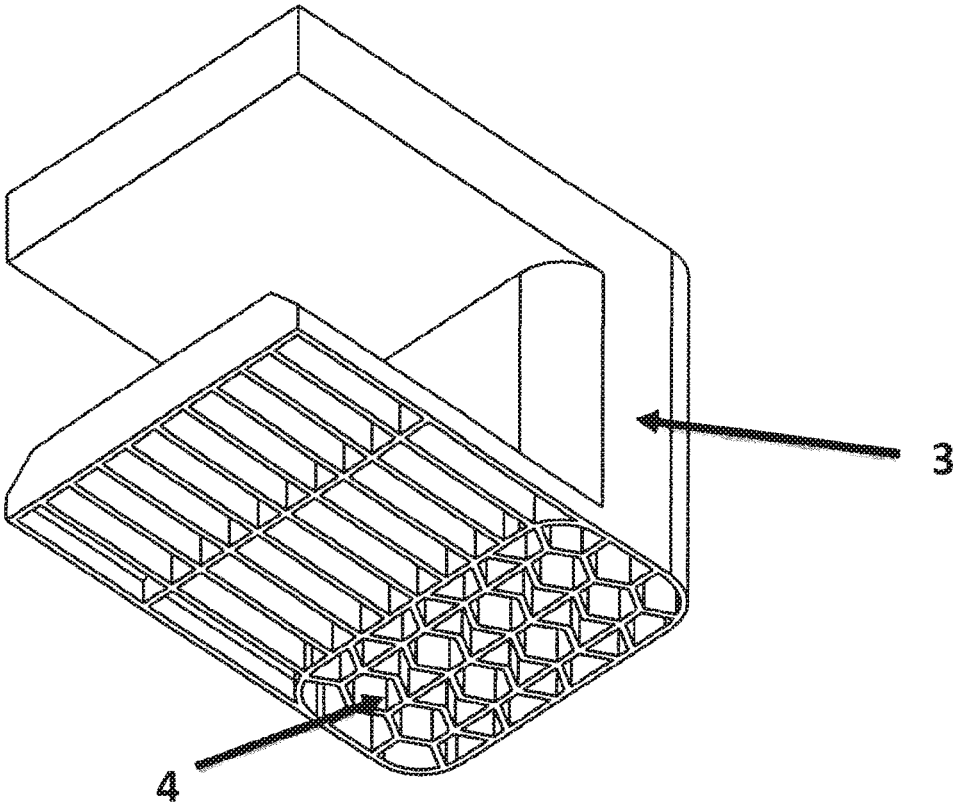
FIG. 14 is a bottom perspective view of the column (3) of the pallet having impact-resistant columns in an embodiment of the present invention, showing the structure for impact energy distribution (4).
Figure 15:
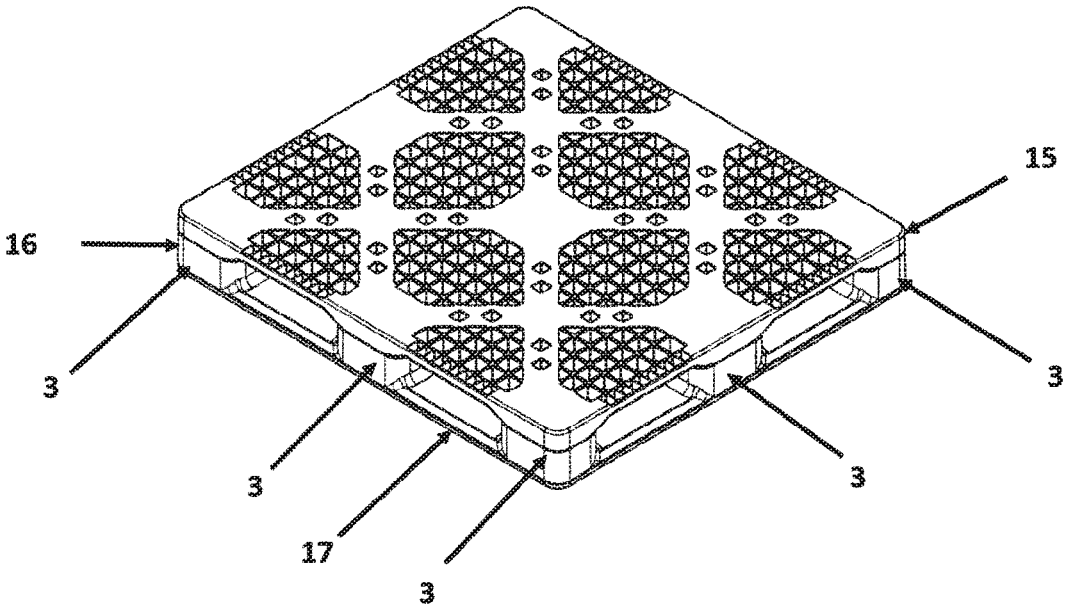
FIG. 15 is a top perspective view of the pallet having impact-resistant columns in an embodiment of the present invention, showing the columns (3), the top cover (15), the central structure (16) and the bottom cover (17).
Figure 18:
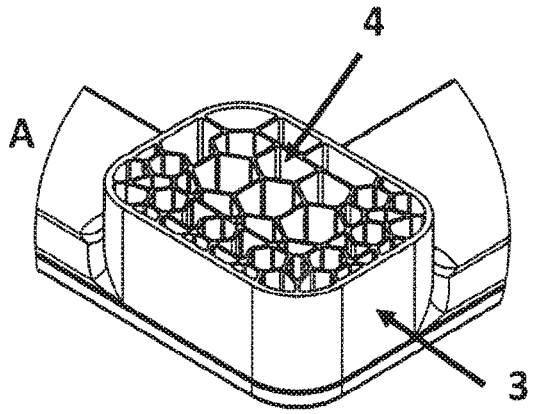
FIG. 18 is a detailed view "A" of the cross section of the top cover (15) of the pallet having impact-resistant columns in an embodiment of the present invention, showing the structure for impact energy distribution (4) inside the column (3).
Figure 19:
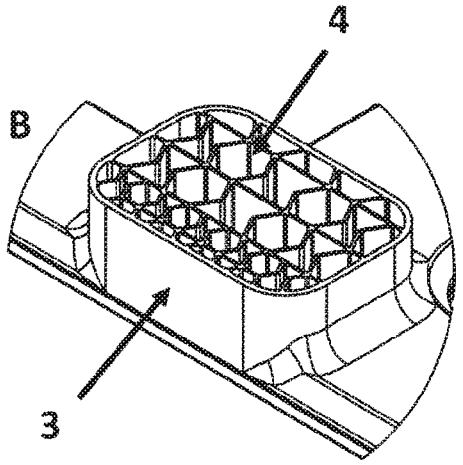
FIG. 19 is a detail view "B" of the cross section of the top cover (15) of the pallet having impact-resistant columns in an embodiment of the present invention, showing the structure for impact energy distribution (4) inside the column (3).
Figure 20:
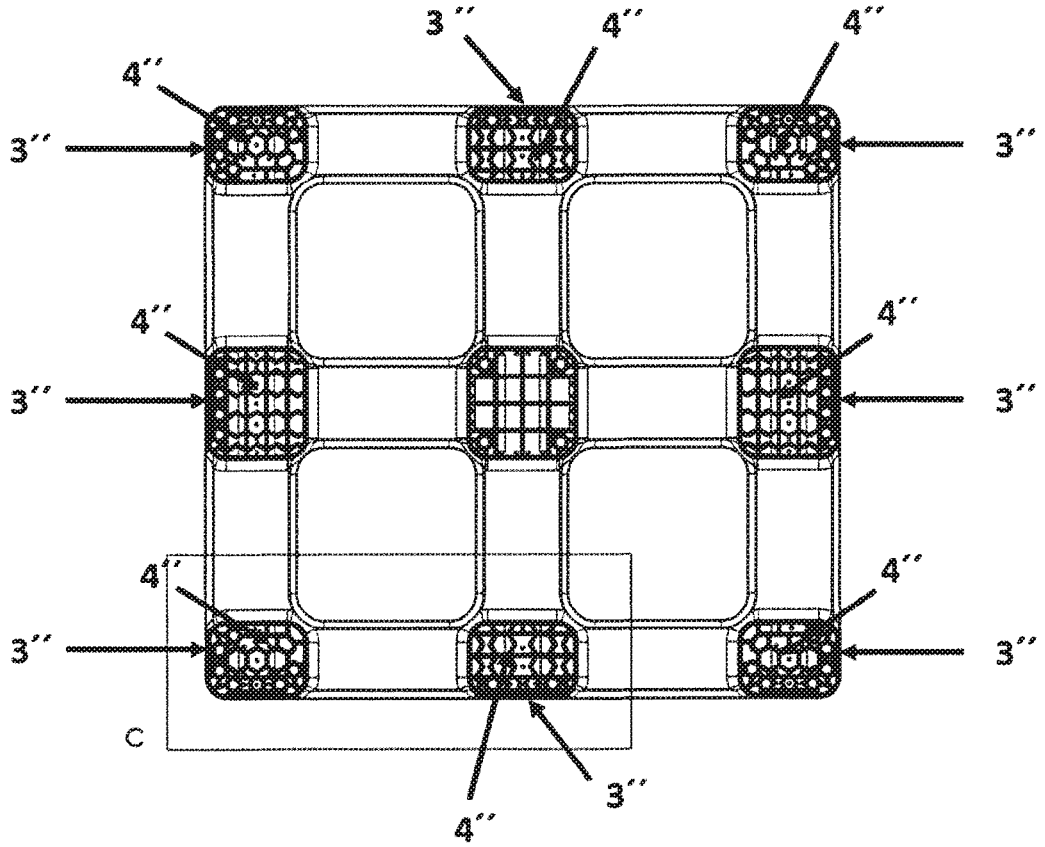
FIG. 20 is a bottom view of the bottom deck (16) of the pallet having impact-resistant columns in an embodiment of the present invention, showing the lower column segments (3") and the lower structure segments for distribution of impact energy (4").
Figure 21:
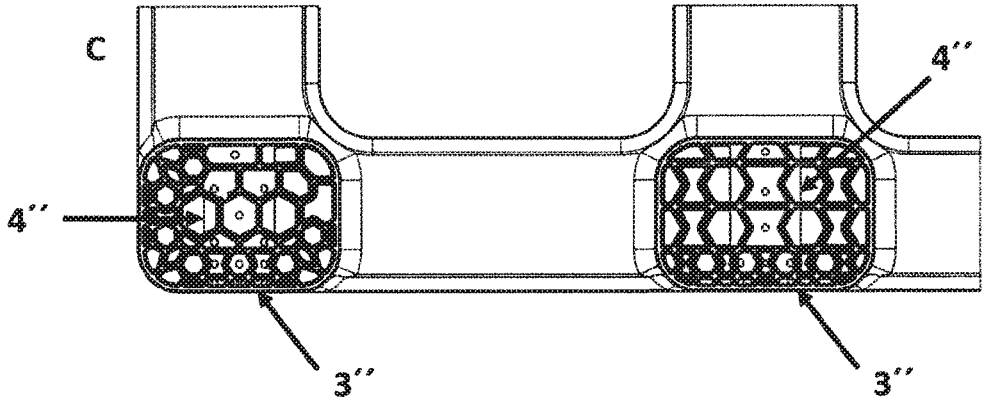
FIG. 21 is a detailed view "C" of the central structure (16) of the pallet having impact-resistant columns in an embodiment of the present invention, showing the lower segments of the structure for impact energy distribution (4") inside the lower column segments (3").

The springs in various of the different embodiments of the invention have a "hexagonal" cross-section, which are the same size, as can be seen in FIGS. 12, 13 and 14, allowing the structure for distributing impact energy (4) to be deformed to absorb the energy produced by the impacts. These "hexagonal" springs are separated from each other. While the springs in one embodiment of the invention also have a "hexagonal" cross-section, however they have different sizes from each other within the same column (3), the springs that are close to the lateral faces of the pallet being smaller than those that are distant from said lateral faces, as can be seen in FIGS. 18 and 19 allowing the structure for the distribution of impact energy (4) to be deformed to absorb the energy produced by the impacts A particular feature of the structure for the distribution of impact energy (4), is its ability to deform by absorbing impacts from the fork of a forklift, which refers to a reversible elastic deformation, However, in case the impact force of the fork exceeds the elastic limit of the structure material for the distribution of impact energy (4), and it undergoes permanent plastic deformation, the pallet having impact-resistant columns of the present invention can still be functional, even with fractures in one or several of its columns (3) due to its "impact compaction" characteristic.

"Impact compaction" refers to the capacity of the structure for the distribution of impact energy (4) to be compacted when the force of the fork impact exceeds the elastic limit of the structure material for the distribution of impact energy. (4), because the springs have different angles at right angles. Said compaction gives rise to a structure that supports the column (3) that received the impact of the fork, or any other type of lateral impact.

Additionally, the "impact compaction" maintains the resistance of the columns (3), even when the impact of the fork exceeds the elastic limit of the structure material for the impact distribution energy (4), since the compaction produces a structure that is impact-resistant.

Therefore, the "impact compaction" allows the pallet having impact-resistant columns of the present invention to remain functional after permanent plastic deformation of one or more of its columns (3) and its structures for the distribution of impact energy. (4), In FIG. 22, the column (19) on the left side, which corresponds to a column of a conventional polypropylene pallet, has an internal reticular structure (14). The mechanical properties of the polypropylene of said pallet are presented below:

| MECHANICAL PROPERTIES | UNIT | MAGNITUDE |
|---|---|---|
| Slotted Izod impact (23° C.) | $kJ/m^2$ | 37.68 P |
| Tensile strength resistance | MPa | 22.04 |
| Young's Modulus | MPa | 956 |
| Density | $g/cm^3$ | 0.934 |

Figure 22:
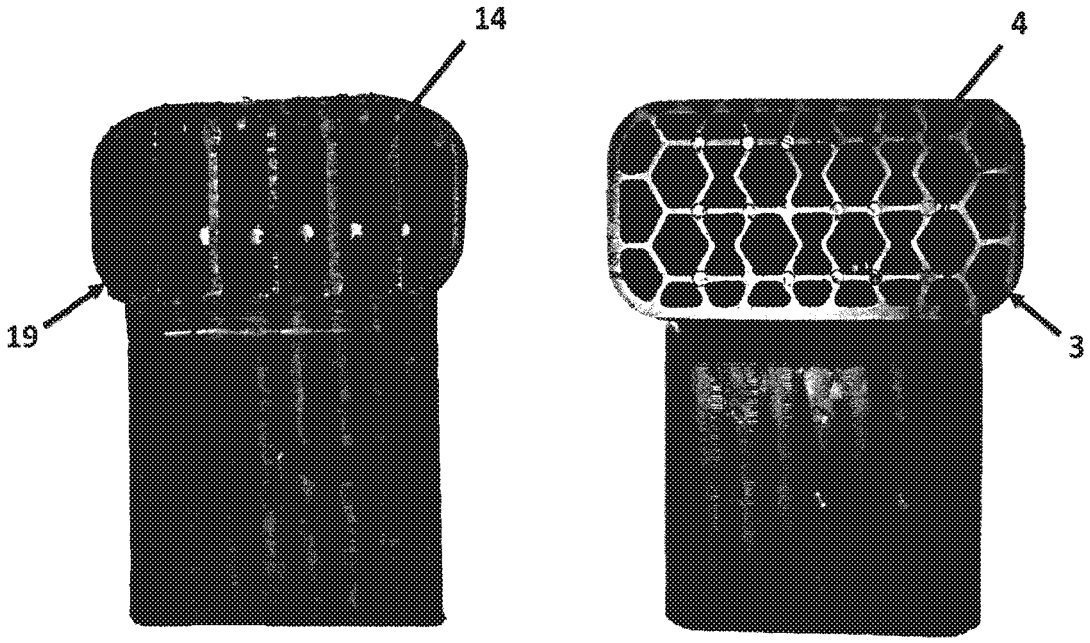
FIG. 22 is a comparative image of the internal structure of the columns of two different pallets before performing an impact test with a forklift fork, where the column (19) on the left side, corresponds to a column of a conventional pallet, formed by an internal reticular structure (14); while the column (3) on the right side, corresponds to a column (3) of the pallet having impact-resistant columns in an embodiment of the present invention, formed by a structure for distribution of impact energy (4).

In the same FIG. 22, the column (3) can also be seen on the right side, corresponding to a column (3) of the polypropylene pallet having impact-resistant columns in an embodiment of the present invention, formed by a structure for distribution of impact energy (4). The mechanical properties of the polypropylene of said pallet are as follows:

| MECHANICAL PROPERTIES | UNIT | MAGNITUDE |
|---|---|---|
| Slotted Izod impact (23° C.) | kJ/m2 | 9.88 H |
| Tensile strength resistance | MPa | 22.67 |
| Young's Modulus | MPa | 1007 |
| Density | $g/cm^3$ | 0.945 |

Thus, the polypropylene used in both pallets is similar in terms of the parameters of tensile strength, Young's modulus and density. However, the polypropylene used for the manufacture of the conventional pallet on the left side has better mechanical impact resistance properties than the polypropylene of the pallet having impact-resistant columns in one embodiment of the present invention, since the grooved Izod impact of the conventional pallet polyethylene is 37.68 P, while the grooved Izod impact of the polyethylene of the pallet having impact-resistant columns in one of the different embodiments of the present invention is 9.86 H.

Figure 23:
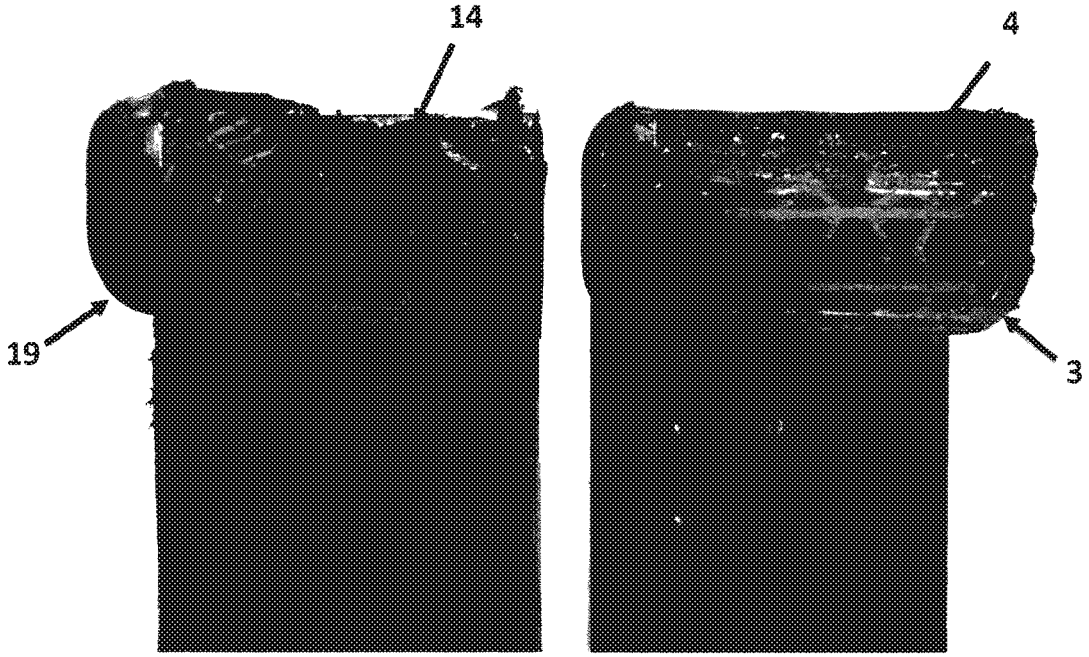
FIG. 23 is a comparative image of the internal structure of the columns in two different pallets after performing an impact test with a forklift fork, where the column (19) on the left side, corresponds to a column of a conventional pallet, formed by an internal reticular structure (14); while the column (3) on the right side, corresponds to a column (3) of the pallet having impact-resistant columns in an embodiment of the present invention, formed by a structure for distribution of impact energy (4)
Figure 24:
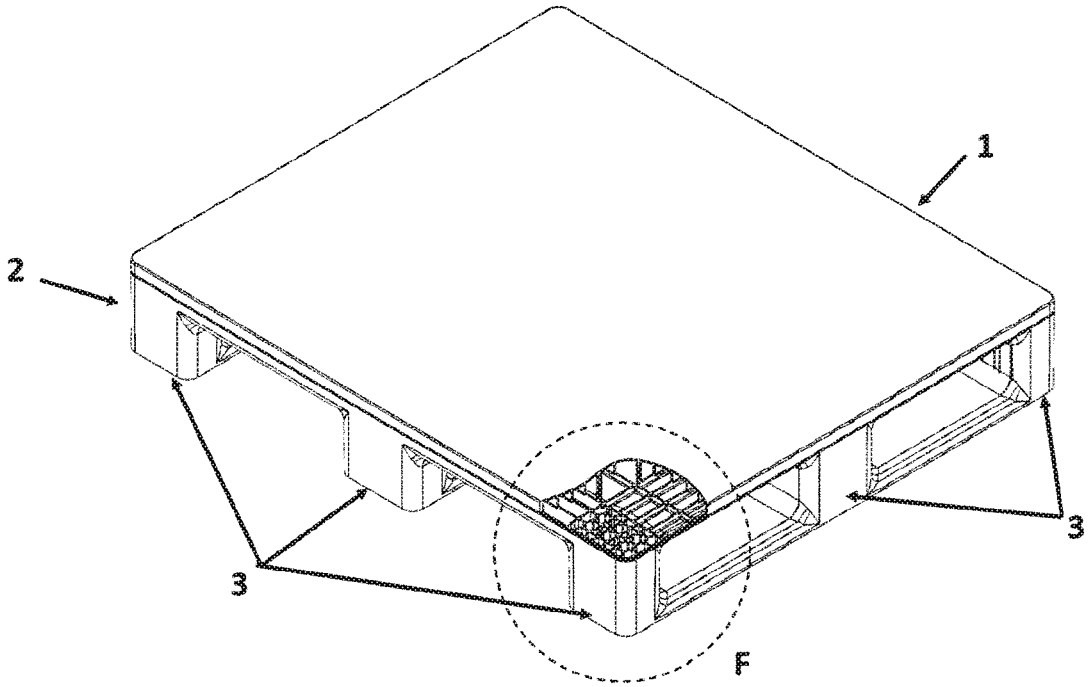
FIG. 24 is a top perspective view of the pallet having impact-resistant columns in an embodiment of the present invention, where the top deck (1) with a partial horizontal cut, the bottom deck (2) and the columns (3).
Figure 25:
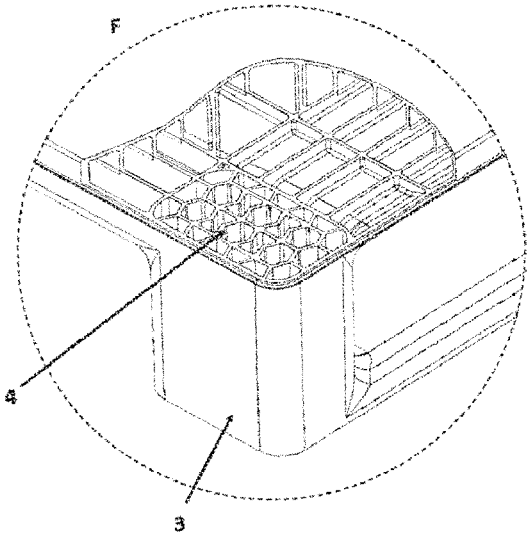
FIG. 25 is a detailed view "F" of the partial horizontal section of the top deck (1) of the pallet having impact-resistant columns in an embodiment of the present invention, showing the structure for impact energy distribution (4) inside the column (3).
Figure 26:
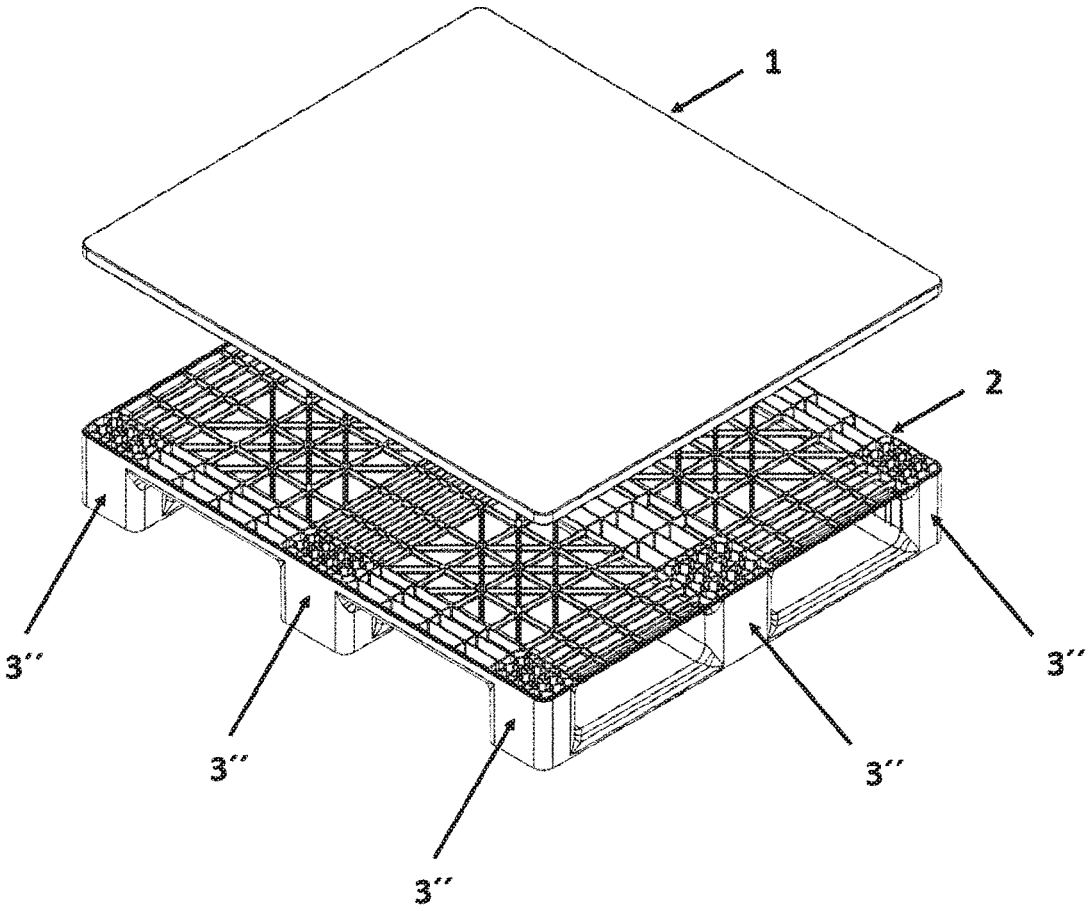
FIG. 26 is a top perspective view of the exploded view of the pallet having impact-resistant columns in an embodiment of the present invention, where the top deck (1), the bottom deck (2) and the lower column segments (3").
Figure 27:
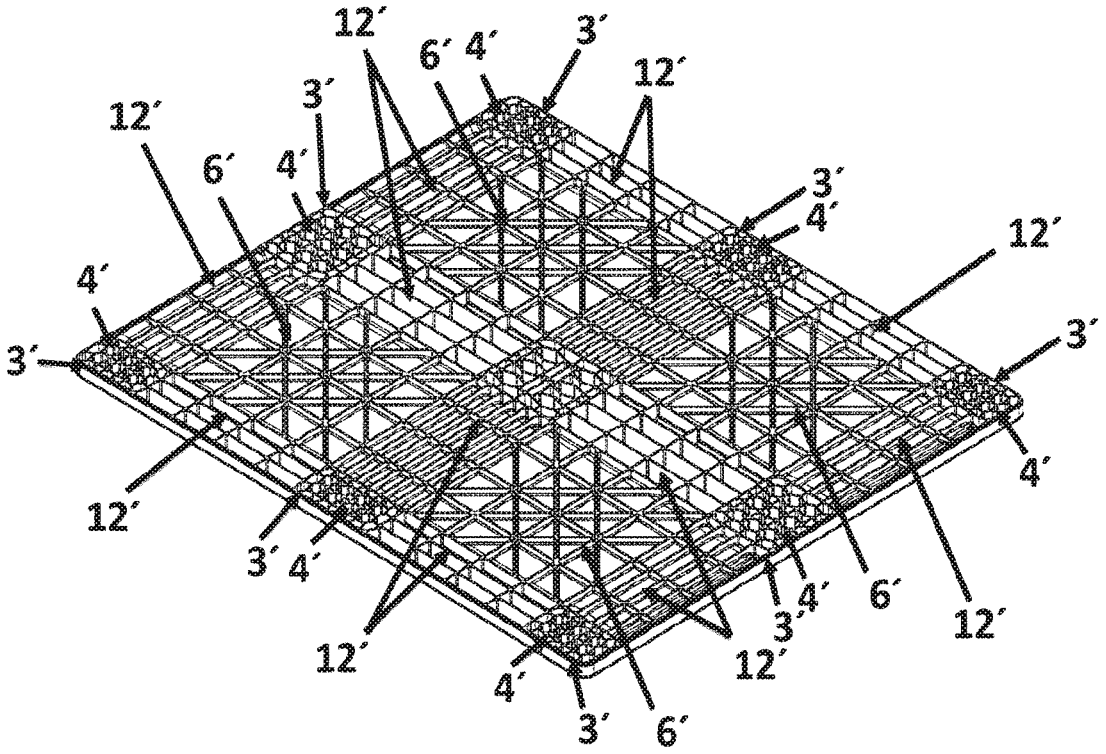
FIG. 27 is a bottom perspective view of the top deck (1) of the pallet having impact-resistant columns in an embodiment of the present invention, showing the upper structure segments for impact energy distribution (4), the upper column segments (3') the crossed ribs (6') and the simple ribs (12').
Figure 28:
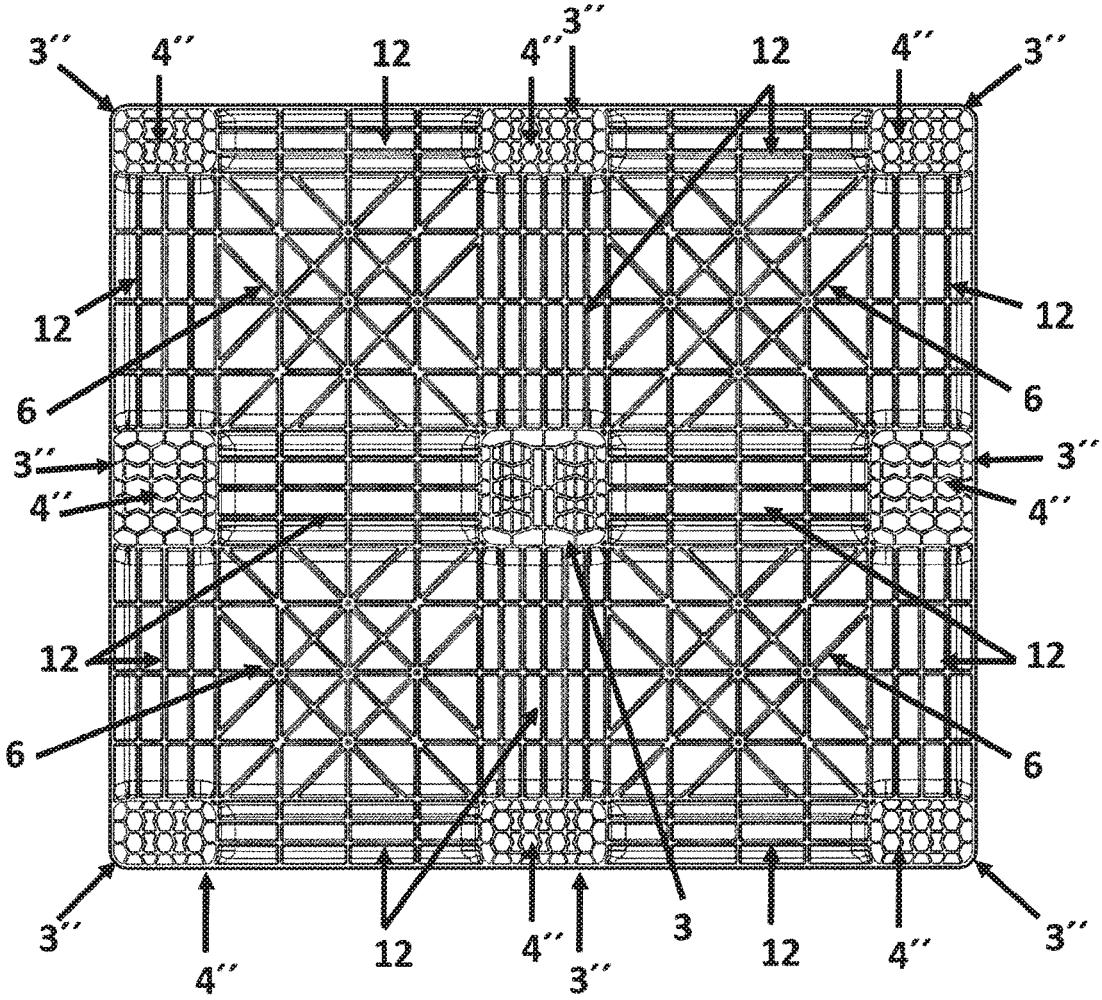
FIG. 28 is a top view of the pallet having impact-resistant columns in an embodiment of the present invention, where the upper structure segments for impact energy distribution (4'), the upper column segments (3'), the crossed ribs (6) and the simple ribs (12).
Figure 29:
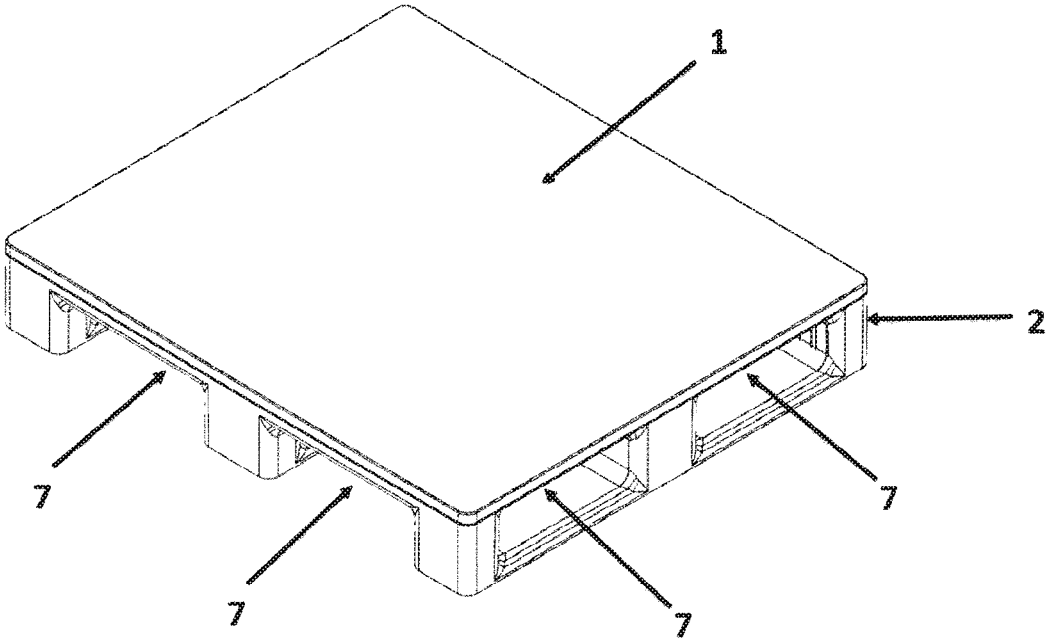
FIG. 29 is a top perspective view of the pallet having impact-resistant columns in an embodiment of the present invention, showing the top deck (1), the bottom deck (2) and fork runners (7).
Figure 30:
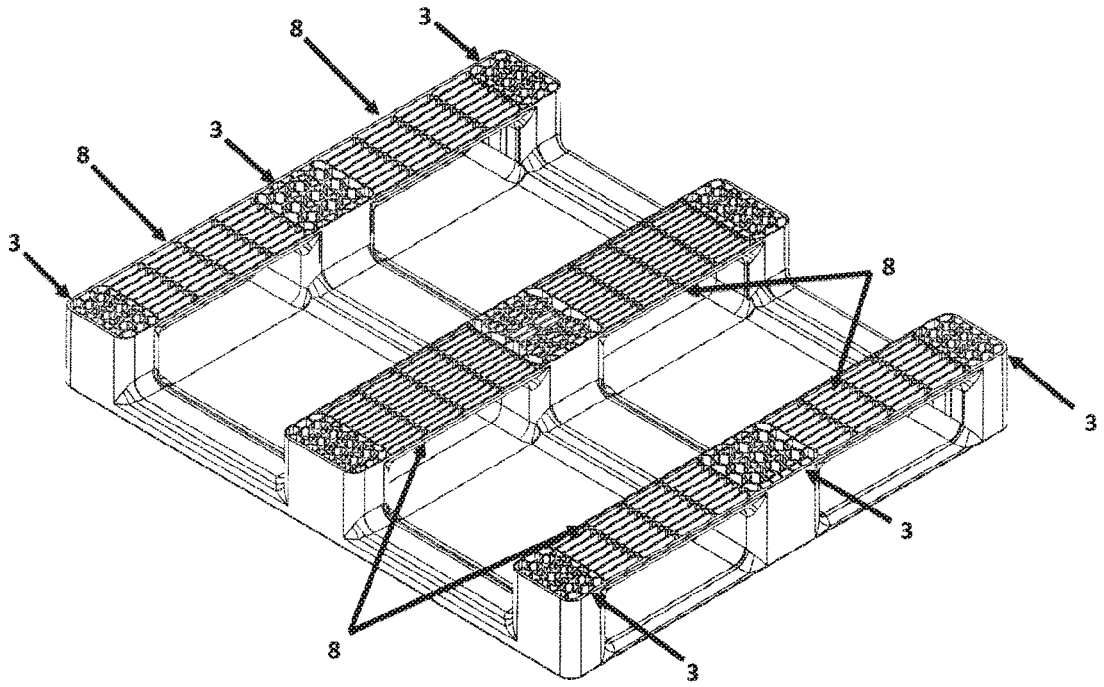
FIG. 30 is a bottom perspective view of the pallet having impact-resistant columns in an embodiment of the present invention, showing the columns (3) and the skates (8).
Figure 31:
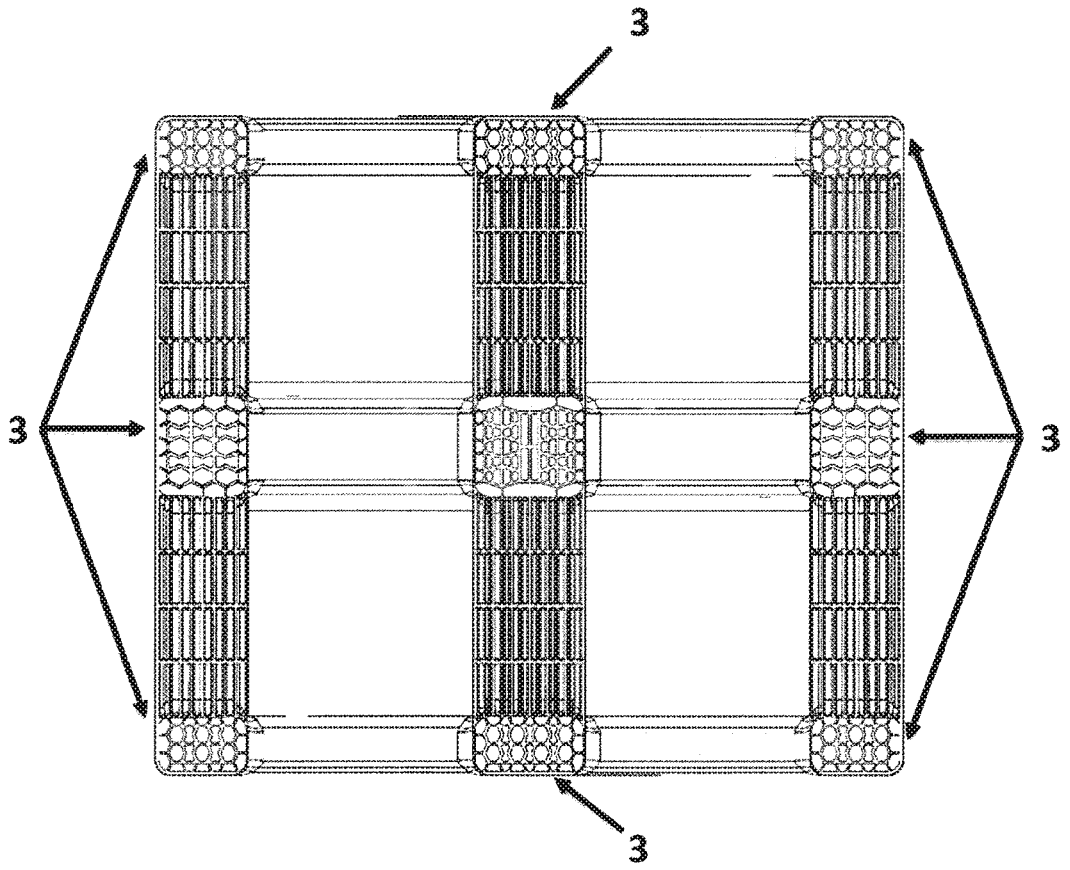
FIG. 31 is a bottom view of the pallet having impact-resistant columns in an embodiment of the present invention, showing the columns (3).

FIG. 23 shows the result of subjecting each of the column in FIG. 22 to three direct impacts of the same magnitude and under the same conditions for both columns. However, the internal reticular structure (14) of the column (19), showed a permanent plastic deformation that prevents it from being functional again, since when placing a load on said column, it collapsed due to structural damage. While the structure for distribution of impact energy (4) of the column (3), had a permanent plastic deformation that allowed it to continue to be functional after said impact test, since when placing the same load on said column (3), it did not collapse because it had "impact compaction".

Considering that the direction of application of the impact goes from the outer part to the inner part of the pallet, the first element to receive the impact is the outer part of the column (3), followed by the plastic foam portion (5) and/or by the pneumatic chamber (13) (when the embodiment includes it), and finally by the structure for the distribution of impact energy (4).

In other embodiments of the pallet of the present invention, each column is formed solely by a structure for the distribution of impact energy (4), and portions of plastic foam (5) or pneumatic chamber (13) are not used, therefore that the structure for the distribution of impact energy (4) is the only element that deforms to absorb the energy produced by the impacts.

On the other hand, in one of the different embodiments of the pallet of the present invention, each column (3) is formed by a pneumatic chamber (13) that surrounds the structure for the distribution of Impact energy (4), whereby plastic foam portions are also not used (5). In such a way that the pneumatic chamber (13) also absorbs the energy produced by the impact, since the air contained in said pneumatic chamber (13) is pressurized, preferably at 3 atmospheres.

The pallet of several of the different embodiments of the invention is made up of two main elements:

a top deck (1), which is a flat plastic plate, where its lower face includes at least one upper segment of column (3') with an upper segment of structure for distribution of impact energy (4') inside, a plurality of crossed ribs (6') and a plurality of simple ribs (12'); and the bottom deck (2), which is a plastic structure made up of a! minus a lower segment of column (3") with a lower segment of structure for impact energy distribution (4") inside, a plurality of crossed ribs (6), a plurality of simple ribs (12), a plurality of fork entries (7), and a plurality of runners (8).

The top deck (1) is a solid plastic flat plate, which can be plain or include some texture or design on its upper face as required. The lower face of said top deck (1) has a special design, such that said design is the reflection of the upper part of the bottom deck (2), that is, it has crossed ribs (6') that coincide with the cross ribs (6) of the bottom deck (2); at least one upper segment of column (3') with an upper structure segment for distribution of impact energy (4') inside, which coincide with at least one lower segment of column (3") and with a lower segment of structure for impact energy distribution (4") of the bottom deck (2); and simple ribs (12') that coincide with the simple ribs (12) of the bottom deck (2). Thus, by having the arrangement of crossed ribs (6'), at least one upper segment of column (3') with an upper segment of structure for distribution of impact energy (4') inside, and single ribs (12') in a top deck (1) matching the crossed ribs (8), at least one lower segment of column (3") with a lower segment of structure for distribution of impact energy (4"), and single ribs (12) in the bottom deck (2) correspondingly, it is possible to have an internal structure (10) of "sandwich" type that increases the resistance to bending and torque of the entire pallet, when the top deck is attached (1) to the bottom deck (2).

The main function of the top deck (1) is to provide a flat support surface for the goods or merchandise placed in its upper part, while its lower part is attached to the bottom deck (2) as already explained. It should be mentioned that, in the case that the upper face of the top deck (1) is a flat solid plastic surface, this will allow for desirable hygienic conditions in specific industries, for example, the pharmaceutical or food industry.

On the other hand, the bottom deck (2) is a plastic structure with hollow parts and solid parts that contribute to increase its mechanical strength, while allowing to save material for its manufacture and reduce the weight of the pallet. The upper part of said bottom deck (2), is formed by a set of crossed ribs (8) and simple ribs (12), which provide resistance to torque and flexion. Said crossed ribs (6) are attached to the crossed ribs (8') of the lower part of the top deck (1), which have the mirror design of the crossed ribs (6) so that both pieces can be joined in a coincident way, thus improving the mechanical properties of the assembly, in the same way as simple ribs (12) and simple ribs (12').

The connection between the top deck (1) and the bottom deck (2) can be carried out by means of different assembly methods, such as by means of heat, glue, snaps, grooves, bolts, ultrasound, high frequency, etc., with hot plate welding being the preferred joining form of the pallet of the present invention.

Additionally, in the embodiments of the pallet of the present invention that include the use of plastic foam portions (5), it is important to note that the plastic foam can be injected into each column (3), so that it optionally provides a molecular union between the pieces that come into contact with it, so that these pieces cannot be easily separated, or, the plastic foam can also be formed separately as an individual piece (without being injected), so that later it can enter into each column (3) as required. However, not all embodiments of the pallet of the present invention require the use of foam.

Figure 5:
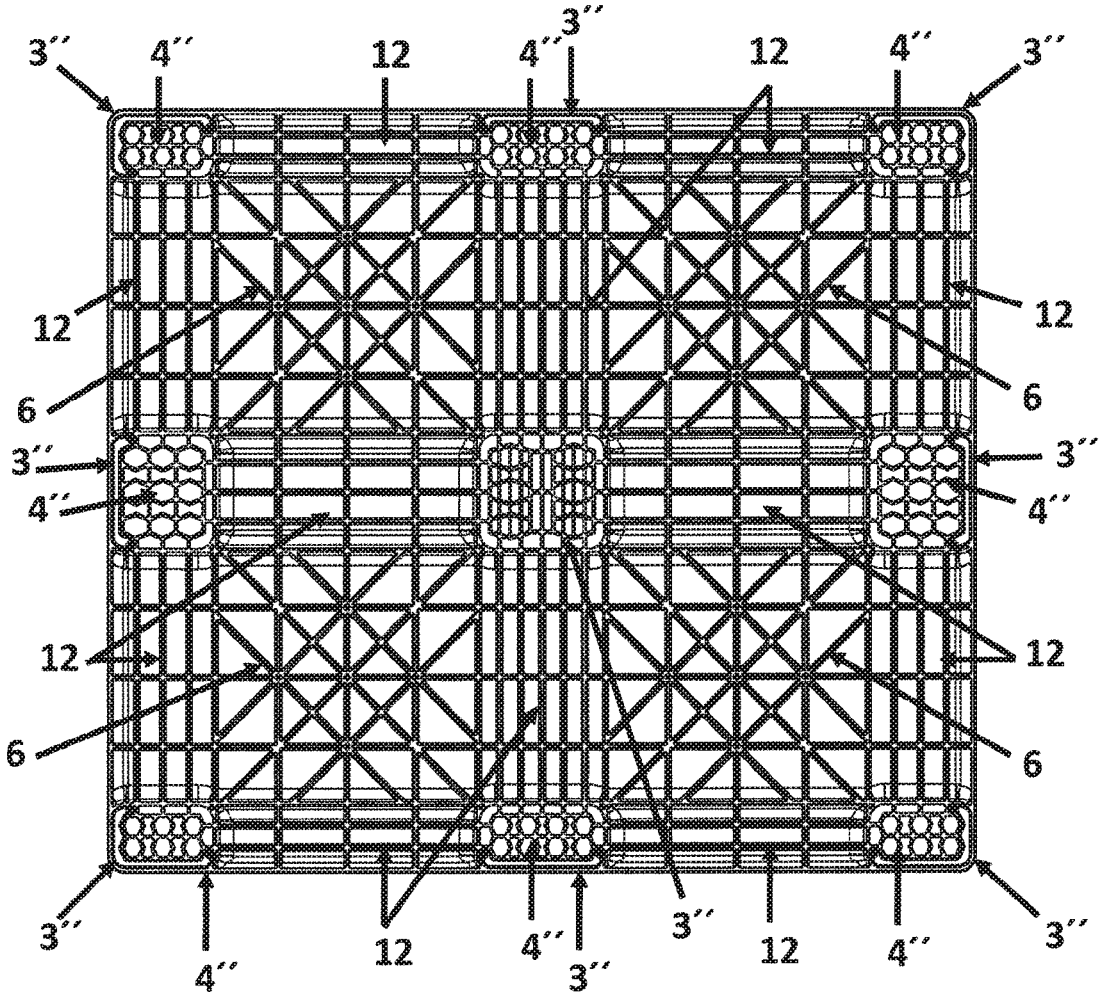
FIG. 5 is a top view of the bottom deck (2) of the pallet having impact-resistant columns in an embodiment of the present invention, showing the lower column segments (3"), the lower structure segments for impact energy distribution (4"), crossed ribs (6) and simple ribs (12).

With respect to FIG. 5, it can be seen that the crossed ribs (6) are formed by diagonal solid beams that are directed from a first lower column segment (3") to a second lower column segment (3"). This arrangement allows the most vulnerable areas of the pallet to be reinforced by flexural forces caused by cargo or transport. Like the crossed ribs (8), FIG. 5 also shows the simple ribs (12), which are solid vertical or horizontal beams, which are directed from a first lower column segment (3") to a second lower column segment (3"). In this sense, it is important to clarify that the diagonal, vertical or horizontal orientation of the solid beams that have been mentioned, take as reference the top view provided in FIG. 5).

In one embodiment of the pallet of the present invention, the plastic foam portions (5), are located in cavities belonging to each column (3) intended for this purpose, whereby each plastic foam portion (5) is located together to a structure for impact energy distribution (4), such that the plastic foam portion (5) mechanically works with the structure for impact energy distribution (4). While in another embodiment of the pallet of the present invention, each pneumatic chamber (13) is formed by an airtight cavity inside each column (3) intended for this purpose, such that the pressurized air of the pneumatic chamber (13) work mechanically with the structure for impact energy distribution (4).

Figure 7:
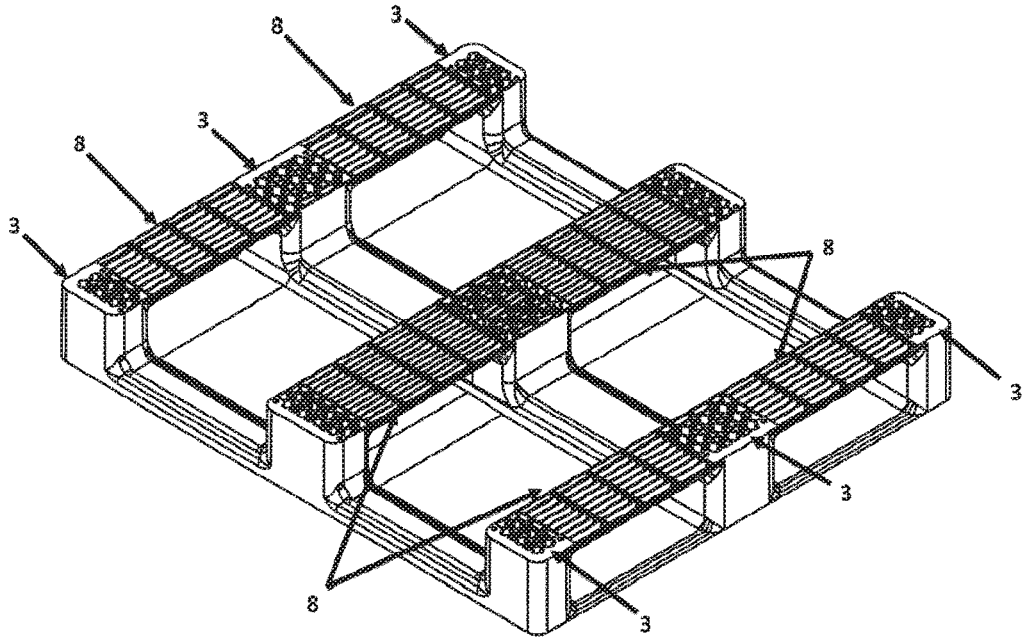
FIG. 7 is a bottom perspective view of the pallet having impact-resistant columns in an embodiment of the present invention, showing the columns (3) and the runners (8).
Figure 8:
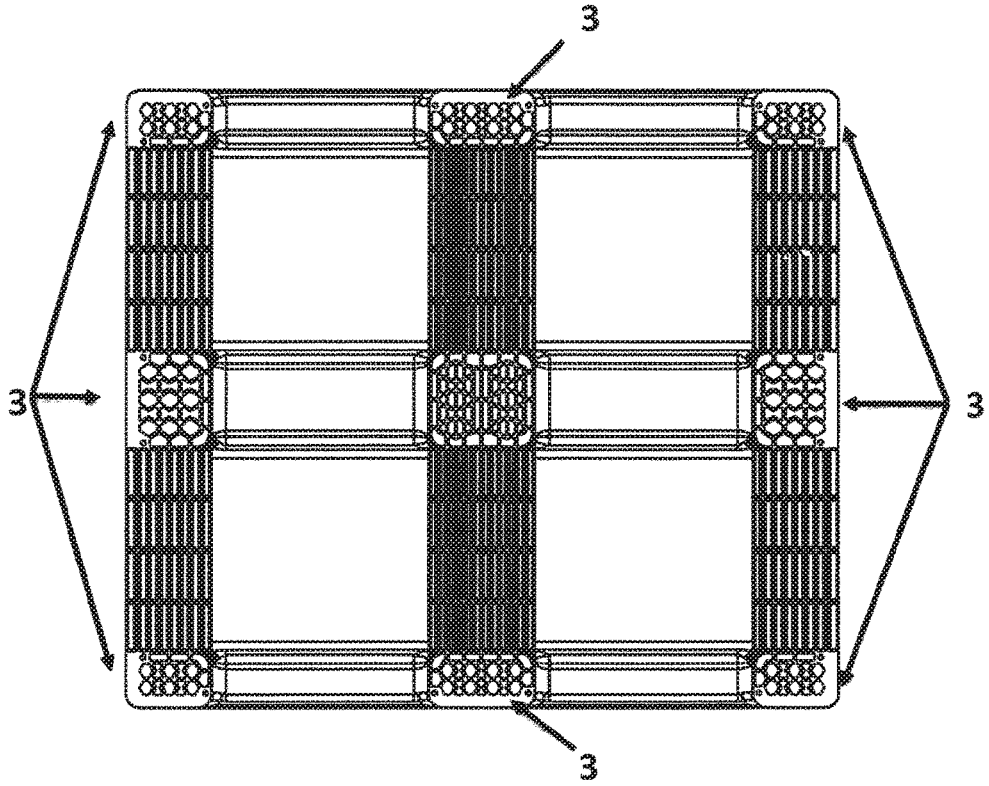
FIG. 8 is a bottom view of the pallet having impact-resistant columns in an embodiment of the present invention, showing the columns (3).
Figure 9:
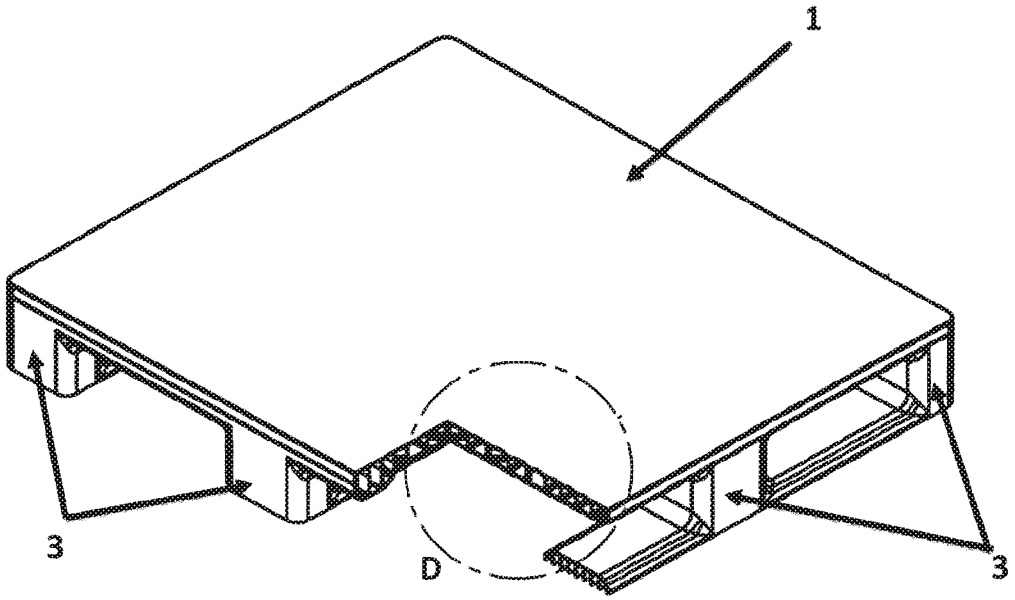
FIG. 9 is a top perspective view of the pallet having impact-resistant columns, showing the top deck (1) with a cross-section and the columns (3).

The runners (8), are formed by solid plastic beams that join the bottom of two columns (3), said solid plastic beams project from a first column (3) to a second column (3), as can be observe in FIGS. 7 and 8.

Figure 6:
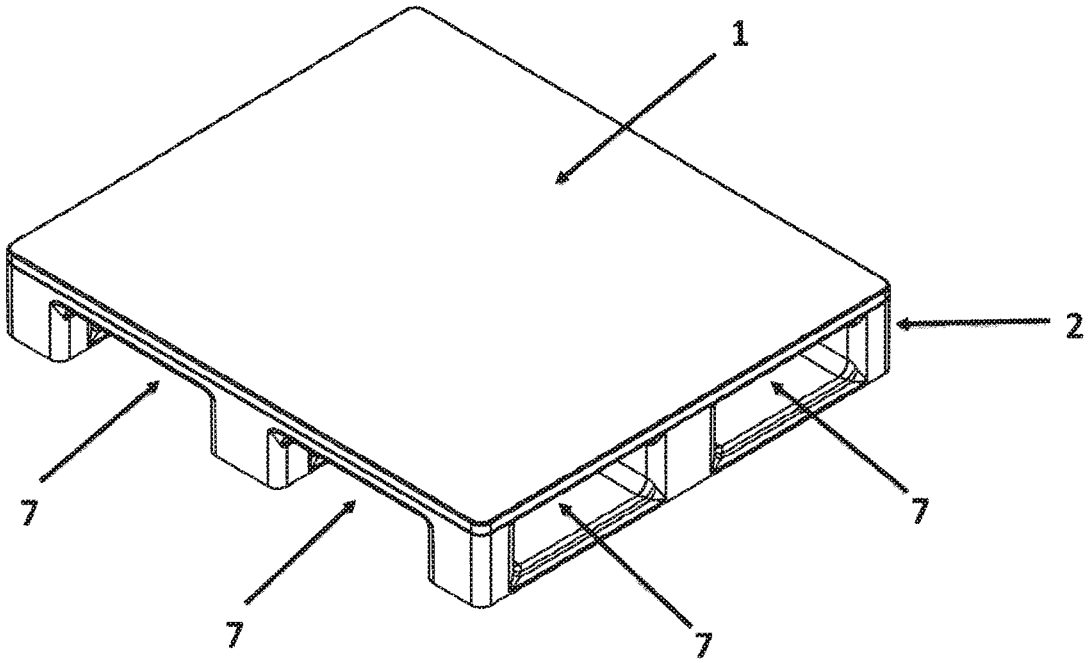
FIG. 6 is a top perspective view of the pallet having impact-resistant columns in an embodiment of the present invention, showing the top deck (1), the bottom deck (2) and fork runners (7).

The fork entries (7) are empty spaces for the forklifts (9) of the forklift to be introduced through them, which are delimited by the bottom of the base (2), two columns (3), and optionally a runner (8), as can be seen in FIG. 6.

In other embodiments of the pallet of the present invention, the crossed ribs (6') can project perpendicularly from the cover (1) as much as necessary to have contact with the crossed ribs (6) of the bottom deck (2), in the same way as the simple ribs (12') of the top deck (1) with the simple ribs (12) of the bottom deck (2), as well as the upper column segments (3') with the lower column segments (3") of the bottom deck (2), and the upper structure segments for impact energy distribution (4') with the lower structure segments for impact energy distribution (4") of the bottom deck (2).

Likewise, the top deck (1) and the bottom deck (2) are joined in such a way that the structures for impact energy distribution (4') of the top deck (1) coincide with the structures for impact energy distribution (4) of the bottom deck (2), as a mirror, providing the mechanical advantages mentioned above. In other embodiments of the pallet of the present invention, the structures for impact energy distribution (4') can be projected perpendicularly from the top deck (1) as much as necessary to have contact with the structures for impact energy distribution (4) of the bottom deck (2), By means of the sandwich connection between the top deck (1) and the bottom deck (2), the pallet of the present invention exhibits resistance to bending and torque, as an internal structure (10) is formed with elements that act mechanically as a beam in "I" avoiding bending, and rectangular gaps between said "I" elements that prevent torque. In this way the internal structure (10) allows to reduce the amplitude of the oscillations during the transport of the goods, which can damage them.

Figure 10:
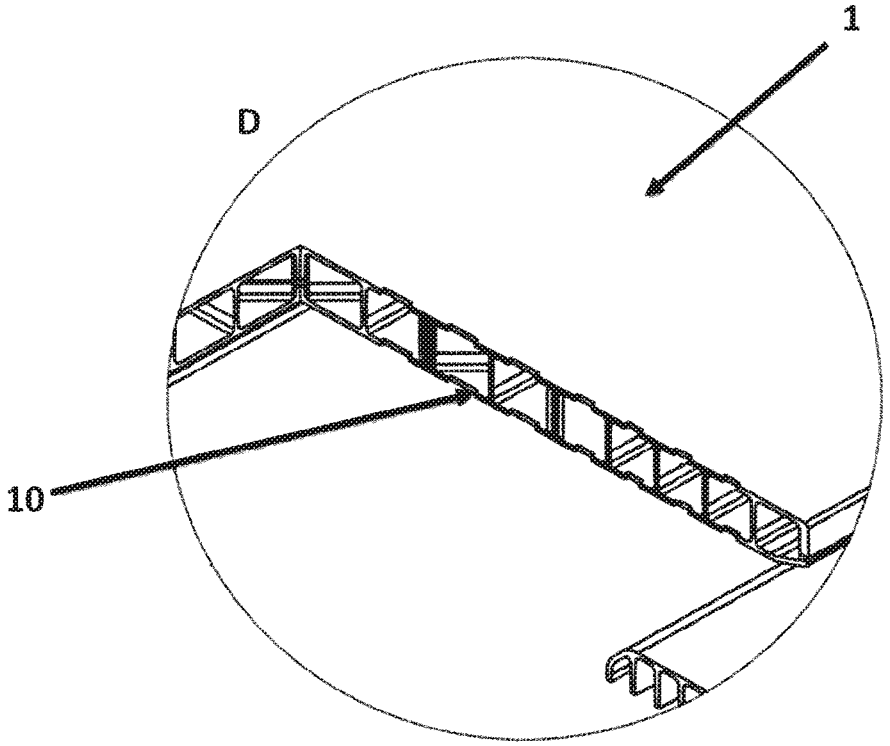
FIG. 10 is a detailed view "D" of the cross-section of the top deck (1) of the pallet having impact-resistant columns, showing the internal structure (10) of the top deck (1).
Figure 11:
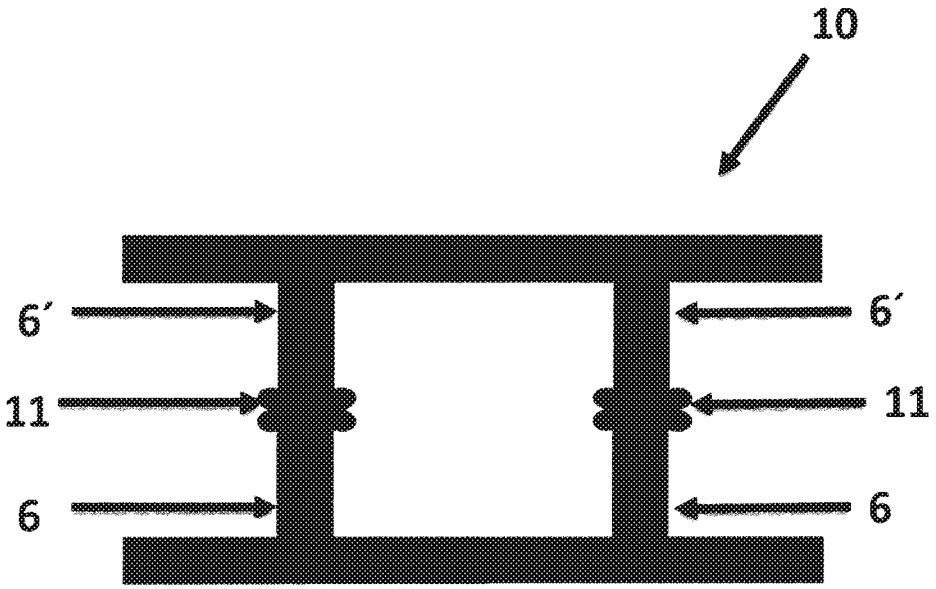
FIG. 11 is a front view of the cross section of the top deck (1) of the pallet having impact-resistant columns, showing the internal structure (10), the crossed ribs (8' and 6) and the welding beads (11).

FIG. 10 shows the pattern or design of the internal structure (10), with elements that act mechanically as "I" beams and rectangular gaps between said elements, which also reduce the weight of the pallet. Additionally, the weld bead (11) that joins the top deck (1) and the bottom deck (2) by means of the crossed ribs (6' and 6); and the simple ribs (12' and 12) are shown. In the same way, the upper column segments (3') are attached to the lower column segments (3"), and the upper segments of structure for distribution of impact energy (4') are attached to the lower segments of structure for distribution of impact energy (4"), by means of a welding bead (11).

Due to the absorption capacity and impact resistance achieved by the columns (3) with structures for impact energy distribution (4) inside, and the resistance to torque and flexion provided by the crossed ribs (6 and 6'), the pallet of the present invention can be used more than once for the transport of goods.

With regard to the materials used for the elaboration of the pallet having impact-resistant columns, it is important to clarify that, although the plastic has been mentioned as a material for its manufacture, it is also possible to replace it with another type of materials such as metals, composite materials, organic materials, etc., for each of its parts. Therefore, the present invention may include different types of materials for its manufacture.

In FIGS. 12, 13 and 14, the configuration of the columns (3) of various of the different forms of the pallet of the present invention are shown, wherein said embodiments are formed by a top deck (1) and a bottom deck (2). Therefore, the configuration of each column (3) of these embodiments is explained below:

Embodiment:

As can be seen in FIG. 12, the column (3) of the pallet having impact-resistant columns, has a structure for distribution of impact energy (4) with "hexagonal" cross-section spring, which is partially surrounded by a portion of plastic foam (5).

Embodiment:

As can be seen in FIG. 13, the column (3) of the pallet having impact-resistant columns, has a structure for impact energy distribution (4) and "hexagonal" cross-section springs, which is surrounded by a pneumatic chamber (13).

Embodiment:

As can be seen in FIG. 14, the column (3) of the pallet having impact-resistant columns, has a structure for distribution of impact energy (4) and "hexagonal" cross-section springs, which does not use plastic foam (5). This embodiment is also illustrated in FIGS. 24-31.

It is important to note that this particular embodiment is one of several preferred embodiments of the present invention.

Embodiment:

That particular embodiment of the pallet of the present invention comprises a top cover (15), which is a flat plate in its upper part;

a central structure (16), which includes columns (3);

a bottom cover (17), which is a flat plate at its bottom; and optional reinforcements (18), which are located between the central structure (16) and the bottom cover (17).

As can be seen in FIGS. 16-21, the columns (3) of the pallet having impact-resistant columns in that particular embodiment, have a structure for impact energy distribution (4) with springs of different "hexagonal" cross-sectional sizes, being smaller the springs that are close to the lateral faces of the pallet.

The invention claimed is:

1. A pallet having impact-resistant columns, comprising:

a top deck comprising an upper face, a lower face, a left side face, a right side face, a front face and a rear face, wherein the lower face includes at least one upper segment of column with an upper segment of structure for distribution of impact energy inside, a plurality of crossed ribs and a plurality of simple ribs;

a bottom deck an upper face, a lower face, a left side face, a right side face, a front face and a rear face, wherein the upper face includes at least one bottom segment of column with a lower segment of structure for distribution of impact energy inside, a plurality of crossed ribs, and a plurality of simple ribs;

wherein the union of the lower face of the top deck with the upper face of the bottom deck, forms at least one column with a structure for distribution of impact energy inside it;

wherein each column comprises a structure for the distribution of impact energy; and wherein the structure for impact energy distribution comprises at least two rows with springs separated from each other in the form of a polygonal prism and/or cylinders and/or portions thereof, the cross section of said polygonal prisms being different from a rectangle or square.

2. The pallet having impact-resistant columns according to claim 1, wherein the bottom deck comprises at least one fork inlet.

3. The pallet having impact-resistant columns according to claim 1, wherein the bottom deck comprises a runner formed by solid plastic beams joining the bottom of two columns, said solid plastic beams project from a first column to a second column.

4. The pallet having impact-resistant columns according to claim 1, wherein at least one column has a plastic foam portion and/or a pneumatic chamber inside, wherein the pneumatic chamber is formed by an airtight cavity inside the at least one column, wherein said airtight cavity contains pressurized air.

5. The pallet having impact-resistant columns according to claim 4, wherein the plastic foam portion is injected into each column, forming a molecular bond between the pieces that come into contact with it, so that the pieces cannot be easily separated.

6. The pallet having impact-resistant columns according to claim 4, wherein the plastic foam portion is separately formed as an individual piece that is subsequently inserted into each column as required.

7. The pallet having impact-resistant columns according to claim 1, wherein the at least one column is located on the periphery of the pallet, and/or in the internal part thereof.

8. The pallet having impact-resistant columns according to claim 1, wherein the structure for the distribution of impact energy of the at least one column is mechanically deformable.

9. The pallet having impact-resistant columns according to claim 1, wherein the orientation of the polygonal prisms coincides with the orientation of the column that contains them, wherein the longitudinal axis of the prisms is parallel or coincides with the longitudinal axis of the column.

10. The pallet having impact-resistant columns according to claim 1, wherein the springs share, partially or totally, one or more of their lateral faces.

11. The pallet having impact-resistant columns according to claim 1, wherein the springs preferably have a cross section in a "hexagonal" shape.

12. The pallet having impact-resistant columns according to claim 1, wherein the springs that are within the same column have different sizes from each other.

13. The pallet having impact-resistant columns according to claim 1, wherein the structure for the distribution of impact energy is capable of compacting when the force of the impact exceeds the elastic limit of the structure material for the distribution of impact energy, where the springs have different angles than right angles, and where the pallet having impact-resistant columns continues to be functional, even with fractures in one or more of its columns due to the ability to compact the structure for the distribution of impact energy and due to springs with different angles than right angles.

14. The pallet having impact-resistant columns according to claim 1, wherein the top deck is plain or includes some texture or design on its upper face, and wherein the crossed ribs in the lower face of the top deck coincide with the cross ribs of the bottom deck upper face.

15. The pallet having impact-resistant columns according to claim 1, wherein the joint between the top deck and the bottom deck is carried out by an assembly method selected in the group comprising: heat, glue, snaps, grooves, bolts, ultrasound, high frequency, and hot plate welding.

16. The pallet having impact-resistant columns according to claim 1, wherein each column is formed by a structure for the distribution of impact energy and a portion of plastic foam.

17. The pallet having impact-resistant columns according to claim 1, wherein the columns provide a capacity for absorption and impact resistance, and the crossed ribs provide resistance to torque and flexion, wherein the columns provide an absorption capacity and impact resistance, the crossed ribs provide resistance to torque and flexion, and the structures for impact energy distribution allow the pallet to be used one or more times for the transport of goods.

18. The pallet having impact-resistant columns according to claim 1, wherein the structure for impact energy distribution includes "hexagonal" cross-section springs and is surrounded by a pneumatic chamber and is partially surrounded by a portion of foam plastic; the springs being smaller in size are close to the lateral faces of the pallet "hexagonal" cross-section springs and does not use plastic foam.

19. The pallet having impact-resistant columns according claim 1, wherein both the top deck and the bottom deck are formed by a plurality of pieces; and wherein both the top deck and the bottom deck are each made individually as a single piece.

20. The pallet having impact-resistant columns according to claim 1, wherein each column comprises a structure for the distribution of impact energy and a pneumatic chamber.

21. The pallet having impact-resistant columns according to claim 20, wherein the pneumatic chamber surrounds the structure for the distribution of impact energy, and wherein the pneumatic chamber is formed by an airtight cavity inside the at least one column, wherein said airtight cavity contains pressurized air.

* * * * *